US006026745A

United States Patent [19]

Hirokawa et al.

[11] Patent Number: 6,026,745

[45] **Date of Patent: *Feb. 22, 2000**

[54] DEVICE FOR CLAMPING AN EDGE OF A PLATE FOR A PRINTING MACHINE

[75] Inventors: Katsushi Hirokawa; Shigeo Fujiwara; Masao Nitta; Mikio Yamaoka, all of Fuchu, Japan

[73] Assignee: Ryobi Ltd., Hiroshima, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/105,369

[22] Filed: Jun. 26, 1998

[30] Foreign Application Priority Data

Jul. 3, 1997 [JP] Japan ..... 9-178126

[51] Int. Cl.[7] ..... B41F 1/28

[52] U.S. Cl. ..... 101/415.1; 101/477

[58] Field of Search ..... 101/415.1, 477

[56] References Cited

U.S. PATENT DOCUMENTS

| | | | |
|---|---|---|---|
| 5,218,907 | 6/1993 | Komori et al. | 101/415.1 |
| 5,309,835 | 5/1994 | Hartung et al. | 101/415.1 |
| 5,363,764 | 11/1994 | Horiguchi et al. | 101/485 |
| 5,479,858 | 1/1996 | Beisel et al. | 101/477 |
| 5,483,892 | 1/1996 | Stiel | 101/477 |
| 5,642,669 | 7/1997 | Becker | 101/415.1 |

*Primary Examiner*—John S. Hilten
*Assistant Examiner*—Dave A. Ghatt
*Attorney, Agent, or Firm*—Merchant & Gould P.C.

[57] ABSTRACT

A tail edge side part 50*b* of a plate 50 disposed on a cylinder surface of a plate cylinder 1 is pushed in a direction of an arrow 100 with a blade 39 rotated in a direction of an arrow 91. At that time, a tail edge side lower plate 6 maintains an initial position. And the tail edge side part 50*b* is clamped by closing a tail edge side upper plate 7 with a condition that the tail edge side part 50*b* is in contact with the tail edge side lower plate 6 by the rotation of the blade 39.

10 Claims, 16 Drawing Sheets

<The first prior art>

<The second prior art>

DEVICE FOR CLAMPING AN EDGE OF A PLATE FOR A PRINTING MACHINE

CROSS-REFERENCE TO RELATED APPLICATIONS

This application is based on Application No. Hei 9-178126 filed on Jul. 3, 1998 in Japan, the content of which is incorporated hereinto by reference.

BACKGROUND OF THE INVENTION

1. Field of the Invention

The present invention relates to a device for clamping an edge of a plate for a printing machine, more specifically, a device for inserting and fixing the edge of the plate between a base and an opening and closing part.

2. Description of the Prior Art

[The first prior art]

FIG. 15A, FIG. 15B FIG. 15C and FIG. 15D show a device for clamping an edge of a plate for a printing machine (hereinafter referred to as the first prior art device) which have been conventionally used. A leading edge side lower plate 72, a leading edge side upper plate 73, a tail edge side lower plate 74 and a tail edge side upper plate 75 are provided in a groove 71 formed on a plate cylinder 70. The leading edge side upper plate 73 can be opened and closed to the leading edge side lower plate 72, and the tail edge side upper plate 75 can also be opened and closed to the tail edge side lower plate 74. Also, both the tail edge side lower plate 74 and the tail edge side upper plate 75 can be rotated in directions of an arrow 90 and an arrow 91 as one united body by centering around a central point 75J.

A pressure roller 76 is provided adjacent to the plate cylinder 70. The pressure roller 76 can also be rotated in both directions of the arrow 90 and the arrow 91 by centering around a central point 76J. A bent strip 77 provided adjacent to the pressure roller 76 can be moved together with the pressure roller 76.

In case of disposing the plate 50 on a cylinder surface 70G of the plate cylinder 70, a leading edge side part 50*a* of the plate 50 is inserted between the leading edge side lower plate 72 and the leading edge side upper plate 73 (FIG. 15A). Then, the leading edge side upper plate 73 is closed to the leading edge side lower plate 72, so that the leading edge side part 50*a* of the plate 50 is clamped and fixed therebetween. Upon fixing the leading edge side part 50*a*, the pressure roller 76 is rotated in the direction of the arrow 91 by centering around a central point 76J. The plate cylinder 70 is rotated in the direction of the arrow 90 under that condition.

The plate 50 is disposed on the cylinder surface 70G of the plate cylinder 70 by rotating the plate cylinder 70 in the direction of the arrow 90. As shown in FIG. 15B, the plate 50 is pressed onto the cylinder surface 70G when the plate 50 is disposed on the cylinder surface 70G of the plate cylinder 70.

As a result of rotating the plate cylinder 70, a tail edge side part 50*b* of the plate 50 is positioned adjacent to the tail edge side lower plate 74 and the tail edge side upper plate 75 as shown in FIG. 15C. Rotation of the plate cylinder 70 is suspended at that position, and the bent strip 77 is moved in the direction of the arrow 91 from the condition. Movement of the bent strip 77 is controlled by actuation of a cylinder (not shown) connected to the bent strip 77.

The tail edge side part 50*b* of the plate 50 is pushed in the direction of the arrow 91 with the nose of the bent strip 77.

As a result, the tail edge side part 50*b* of the plate 50 is directed to a space 78 formed between the tail edge side lower plate 74 and the tail edge side upper plate 75 as shown in FIG. 15D.

Both the tail edge side lower plate 74 and the tail edge side upper plate 75 are rotated in the direction of the arrow 90 by centering around the central point 75J. The tail edge side part 50*b* of the plate 50 is inserted between the space 78 by the rotation. Then, the tail edge side upper plate 75 is closed to the tail edge side lower plate 74, so that tail edge side part 50*b* of the plate 50 is clamped and fixed therebetween.

Upon disposing the plate 50 on the plate cylinder 70 as described above, both the tail edge side lower plate 74 and the tail edge side upper plate 75 are automatically returned to their original positions by rotating around the central point 75J. As a result, the tail edge side part 50*b* of the plate 50 is pulled in the direction of the arrow 91. Thus, the plate 50 is fitted tightly on the cylinder surface 70G of the plate cylinder 70 as a result of applying tension.

[The second prior art]

Another device for clamping an edge of a plate for a printing machine (hereinafter referred to as the second prior art device) which have been conventionally used will be described herein with reference to FIG. 16. FIG. 16 is a sectional side elevation which shows the periphery of a tail edge side lower plate 84 and a tail edge side upper plate 85. Both the tail edge side lower plate 84 and the tail edge side upper plate 85 are mounted in a groove 81 formed on a plate cylinder 80.

A rack gear 83 is fixed to the tail edge side lower plate 84 as one united body. All the rack gear 83, tail edge side lower plate 84 and the tail edge side upper plate 85 are movable in directions of an arrow 92 and an arrow 93. Further, a plurality of coil springs 79 are provided into the tail edge side lower plate 84, so that the tail edge side lower plate 84 is pushed in the direction of the arrow 92 with the coil springs 79.

On the other hand, a driving shaft 82 is connected rotatably to the plate cylinder 80. A pinion gear 82G is fixed to the driving shaft 82. The pinion gear 82G is engaged with the rack gear 83. In other words, both the tail edge side lower plate 84 and the tail edge side upper plate 85 are moved in the directions of the arrow 92 and the arrow 93 through both the pinion gear 82G and the rack gear 83 in accordance with the rotation of the driving shaft 82.

Both the tail edge side lower plate 84 and the tail edge side upper plate 85 are in a retracted position in the direction of the arrow 92 when a tail edge side part 50*b* of the plate 50 thus disposed on the cylinder surface of the plate cylinder 80 is positioned adjacent to the tail edge side lower plate 84 and the tail edge side upper plate 85.

Further, a blade 87 is provided adjacent to the plate cylinder 80. The tail edge side part 50*b* of the plate 50 is pushed into the groove 81 by the movement of the blade 87 in a direction of an arrow 94. Both the tail edge side lower plate 84 and the tail edge side upper plate 85 are moved toward in the direction of the arrow 93 by the rotation of the driving shaft 82 from the condition.

Thus, the tail edge side part 50*b* of the plate 50 is inserted into the space formed between the tail edge side lower plate 84 and the tail edge side upper plate 85 by the movement of the plates. FIG. 16 is a view illustrating insertion of the tail edge side part 50*b* into the space.

Then, the tail edge side upper plate 85 is closed to the tail edge side lower plate 84, so that the tail edge side part 50*b* of the plate 50 is clamped and fixed therebetween. Upon fixing the tail edge side part 50*b*, both the tail edge side lower plate 84 and the tail edge side upper plate 85 are moved in the direction of the arrow 92 with clamping the tail edge side part 50*b* therebetween. Thus, the plate 50 is fitted tightly on the cylinder surface of the plate cylinder 80 as a result of applying tension.

However, the devices of the first prior art device and the second prior art device described above have following problems to be resolved. In the device of the first prior art shown in FIG. 15, the device need to carry out following steps in order to clamp and fix the tail edge side part 50*b*. One of the steps is to insert the tail edge side part 50*b* between the space 78 formed between the tail edge side lower plate 74 and the tail edge side upper plate 75 by rotating both the plates in the direction of the arrow 90. Another step is to clamp and fix the tail edge side part 50*b* between the plates by closing the tail edge side upper plate 75 to the tail edge side lower plate 74 after the insertion.

As described above, these two steps need to be carried out separately. Therefore, it takes much time to complete these steps. Further, in order to carry out the steps described above, much complicated mechanisms and control are required to the device of the first prior art device.

Still further, stopping accuracy of the rotation of the plate cylinder 70 and positioning accuracy of the tail edge side part 50*b* guided with pressure of the bent strip 77 are required in order to insert the tail edge side part 50*b* between the space 78 having relatively narrower width. The tail edge side part 50*b* can not be inserted between the space 78 even when both the tail edge side lower plate 74 and the tail edge side upper plate 75 are rotated in a direction of the arrow 94 in case of carrying out inaccurate positioning of the tail edge side part 50*b* and/or insufficient stopping accuracy of the rotation of the plate cylinder 70.

Therefore, the plate cylinder 70 can not be rotated in a high speed for maintaining stopping accuracy of the plate cylinder 70. As a result, work efficiency of the printing work is decreased. Further, there is a higher probability that the tail edge side part 50*b* is not inserted reliably between the space 78 when the tail edge side part 50*b* of the plate 50 is curved outwardly or inwardly.

Also, the second prior art device shown in FIG. 16 have similar problems to that of the first prior art device described above. The tail edge side part 50*b* is inserted into the space formed between the tail edge side lower plate 84 and the tail edge side upper plate 85 by moving both the plates 84 and 85 in the direction of the arrow 93 after pushing the tail edge side part 50*b* with the blade 87 in the direction of the arrow 94. Then, the tail edge side part 50*b* must be fixed by closing the tail edge side upper plate 85 to the tail edge side lower plate 84.

In order to fix the tail edge side part 50*b*, the device need to carry out the following steps. One of the steps is to move both the tail edge side lower plate 84 and the tail edge side upper plate 85 in a direction of the arrow 93. Another step is to close the tail edge side upper plate 85 to the tail edge side lower plate 84. It take much time to complete these steps, and much complicated mechanisms and control are required to the device of the second prior art. Further, there is a higher probability that the tail edge side part 50*b* is not inserted reliably between the space even when both the tail edge side lower plate 84 and the tail edge side upper plate 85 are moved in a direction of the arrow 93 in case of occurring outward/inward curvature of the tail edge side part 50*b*.

OBJECTS AND SUMMARY OF THE INVENTION

It is an object of the present invention to provide a device for clamping an edge of a plate for a printing machine capable of simplifying both mechanisms and control thereof as well as achieving a shorter working period, the device is also able to clamp and fix the edge of the plate and vicinity thereof by inserting the edge and the vicinity into a space formed between a base and an opening and closing part.

In accordance with characteristic of the present invention, there is provided a device for clamping an edge of a plate for a printing machine comprises:

a base mounted on a plate cylinder and having a base surface, and the base being movable between an initial position and a moved position, an opening and closing part mounted on the plate cylinder and having a clamping surface, the opening and closing part being capable of moving both in a closing direction for approaching the clamping surface to the base surface and in an opening direction for withdrawing the clamping surface from the base surface in order to form an inserting space between the clamping surface and the base surface, and a guide part for guiding the edge of the plate and vicinity thereof into the inserting space, wherein the edge of the plate and the vicinity thereof is guided into the inserting space formed between the clamping surface and the base surface with the guide part when the base is positioned at the initial position, and wherein the edge of the plate and the vicinity thereof is clamped and fixed between the clamping surface and the base surface of the base by moving the opening and closing part in the closing direction when the base is positioned at the initial position.

While the novel features of the invention are set forth in a general fashion, both as to organization and content, it will be better understood and appreciated, along with other objections and features thereof, from the following detailed description taken in conjunction with the drawings.

DESCRIPTION OF THE PREFERRED EMBODIMENT

An embodiment of a device for clamping an edge of a plate for a printing machine in the present invention will be described with reference to figures.

Figure 1:
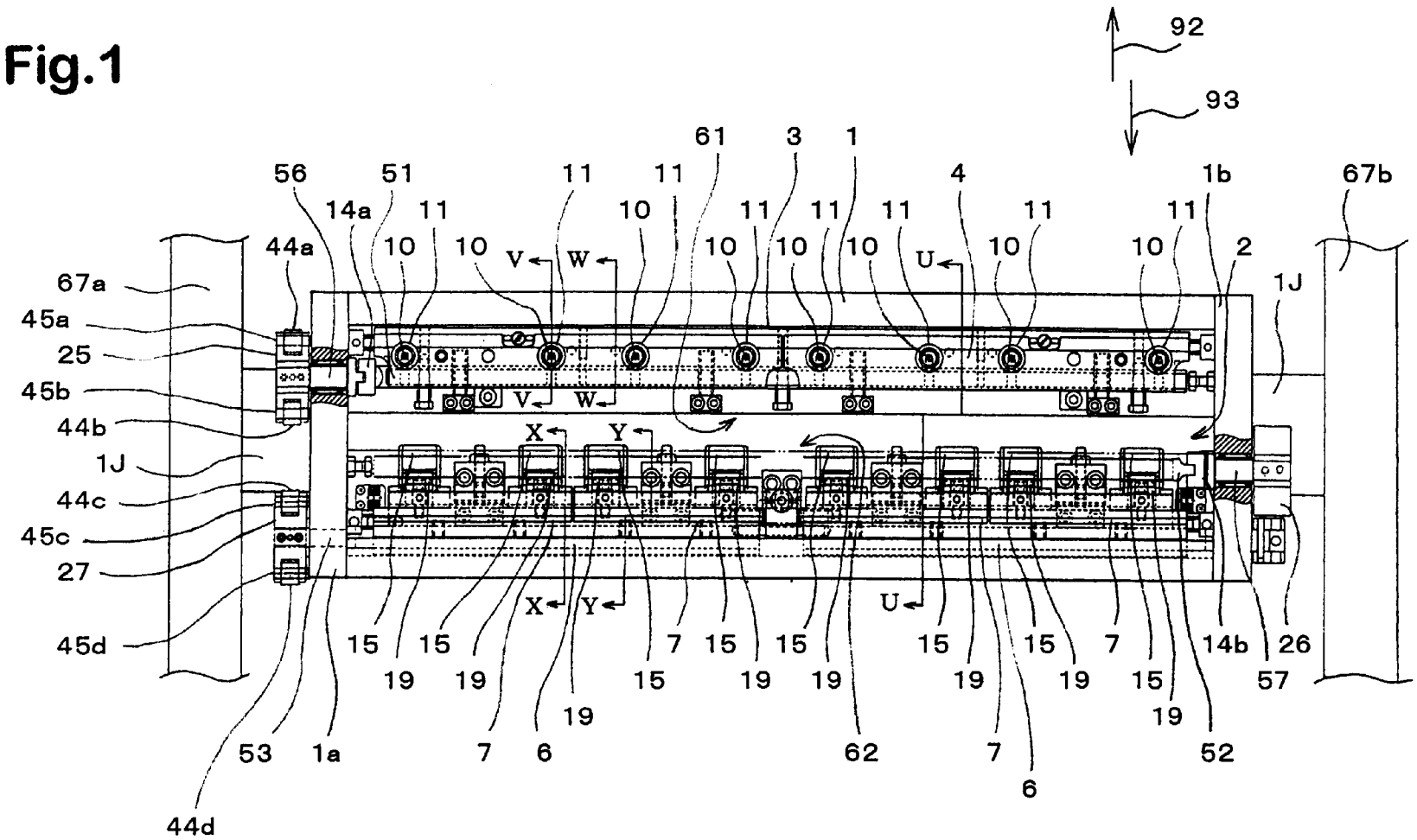
FIG. 1 is a plan view of a plate cylinder mounting a device for clamping an edge of a plate for a printing machine as an embodiment of the present invention.

FIG. 1 is a plane view of a plate cylinder 1 mounting the device for clamping the edge of the plate in the present invention. FIG. 2A, FIG. 2B, FIG. 3A and FIG. 3B are cross sectional views taken along line U—U of FIG. 1, each showing a procedure for disposing the plate 50 on a plate cylinder.

Figure 4A:
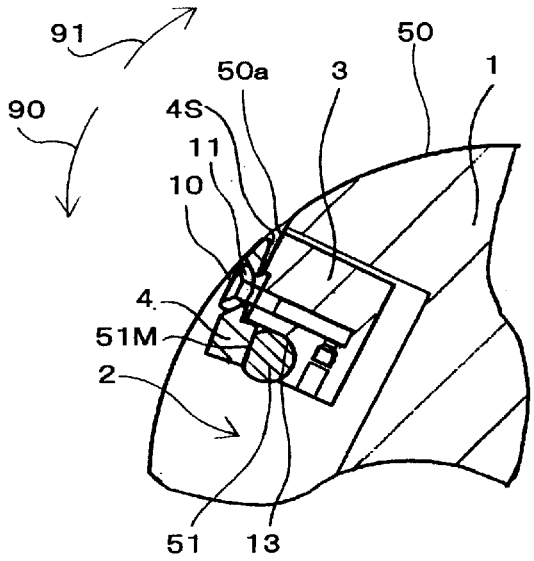
FIG. 4A is a cross sectional view taken along line V—V of FIG. 1.
Figure 4C:
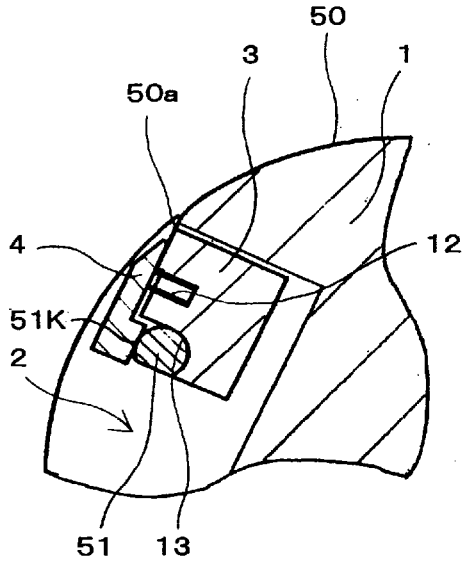
FIG. 4C is another cross sectional view taken along line W—W of FIG. 1.
Figure 4B:
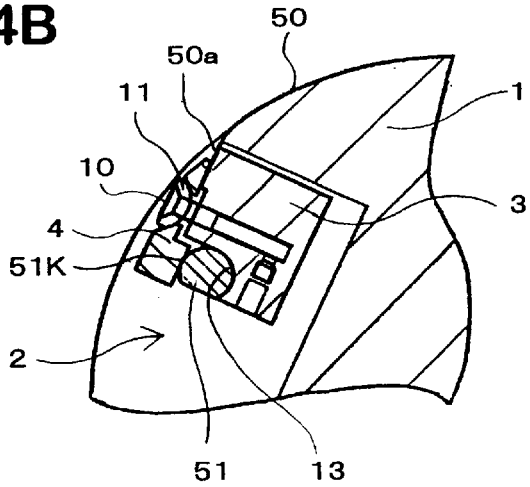
FIG. 4B is another cross sectional view taken along line V—V of FIG. 1.

Further, FIG. 4A and FIG. 4B are cross sectional views taken along line V—V of FIG. 1, and FIG. 4C is another cross sectional view taken along line W—W of FIG. 1.

Figure 5A:
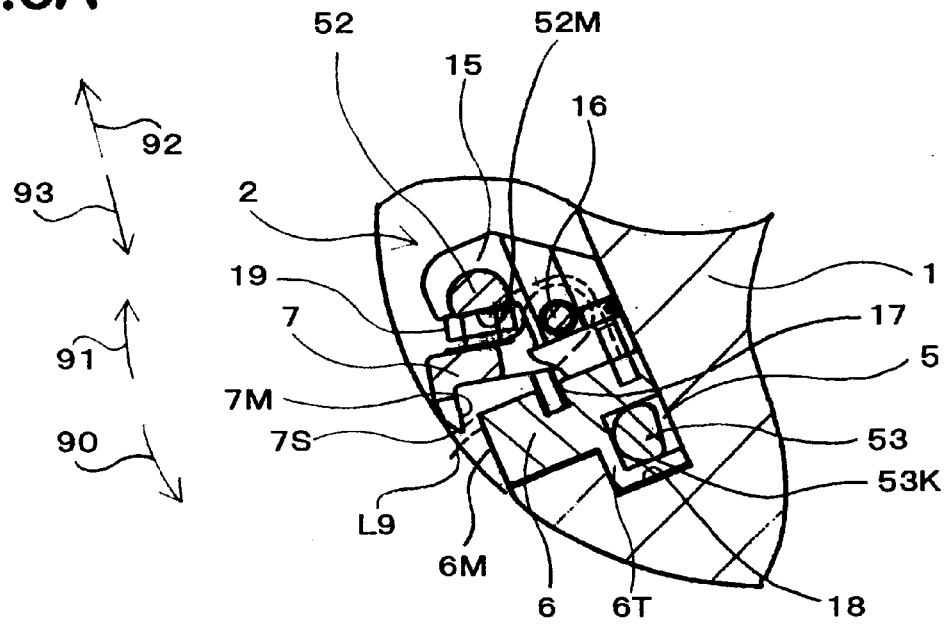
FIG. 5A is a cross sectional view taken along line X—X of FIG. 1.
Figure 5B:
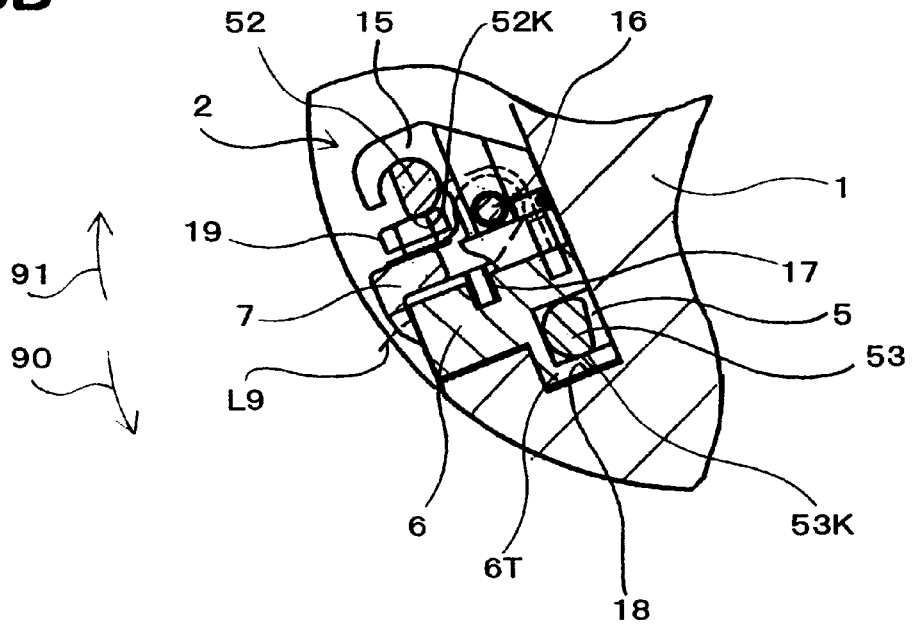
FIG. 5B is another cross sectional view taken along line X—X of FIG. 1.
Figure 6A:
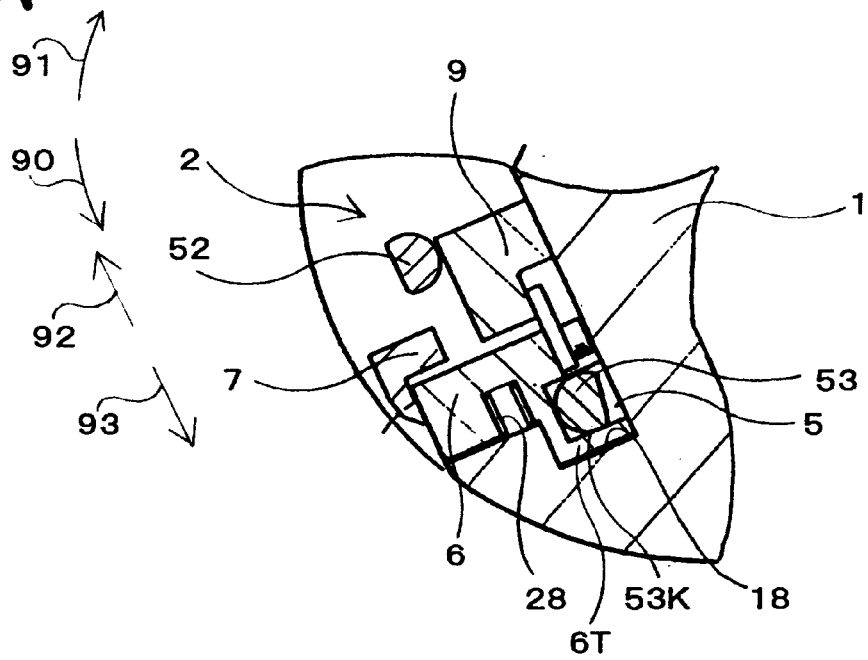
FIG. 6A is a cross sectional view taken along line Y—Y of FIG. 1.
Figure 6B:
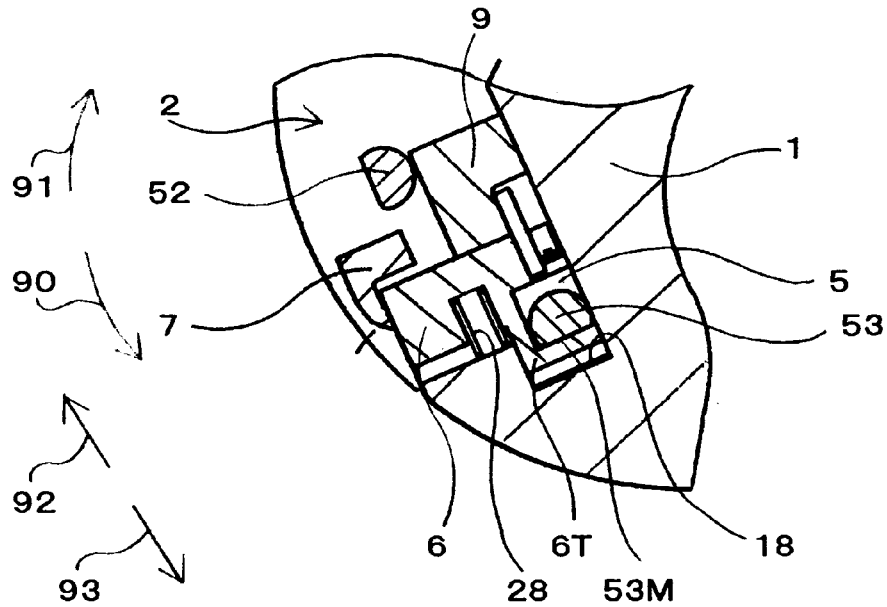
FIG. 6B is another cross sectional view taken along line Y—Y of FIG. 1.

Still further, both FIG. 5A and FIG. 5B are cross sectional views taken along line X—X of FIG. 1, and FIG. 6A and FIG. 6B are cross sectional views taken along line Y—Y of FIG. 1.

Figure 7:
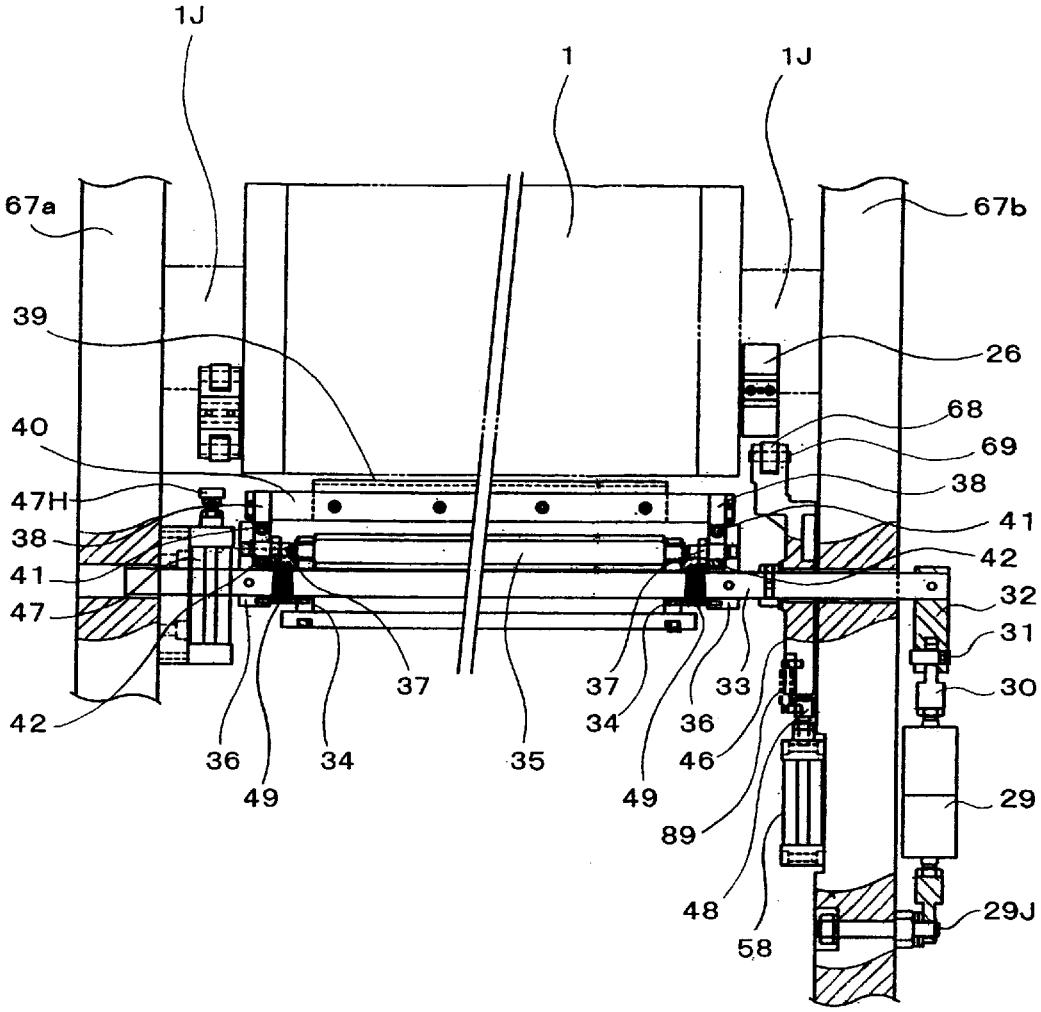
FIG. 7 is a plan view of the plate cylinder 1 and periphery thereof.
Figure 8:
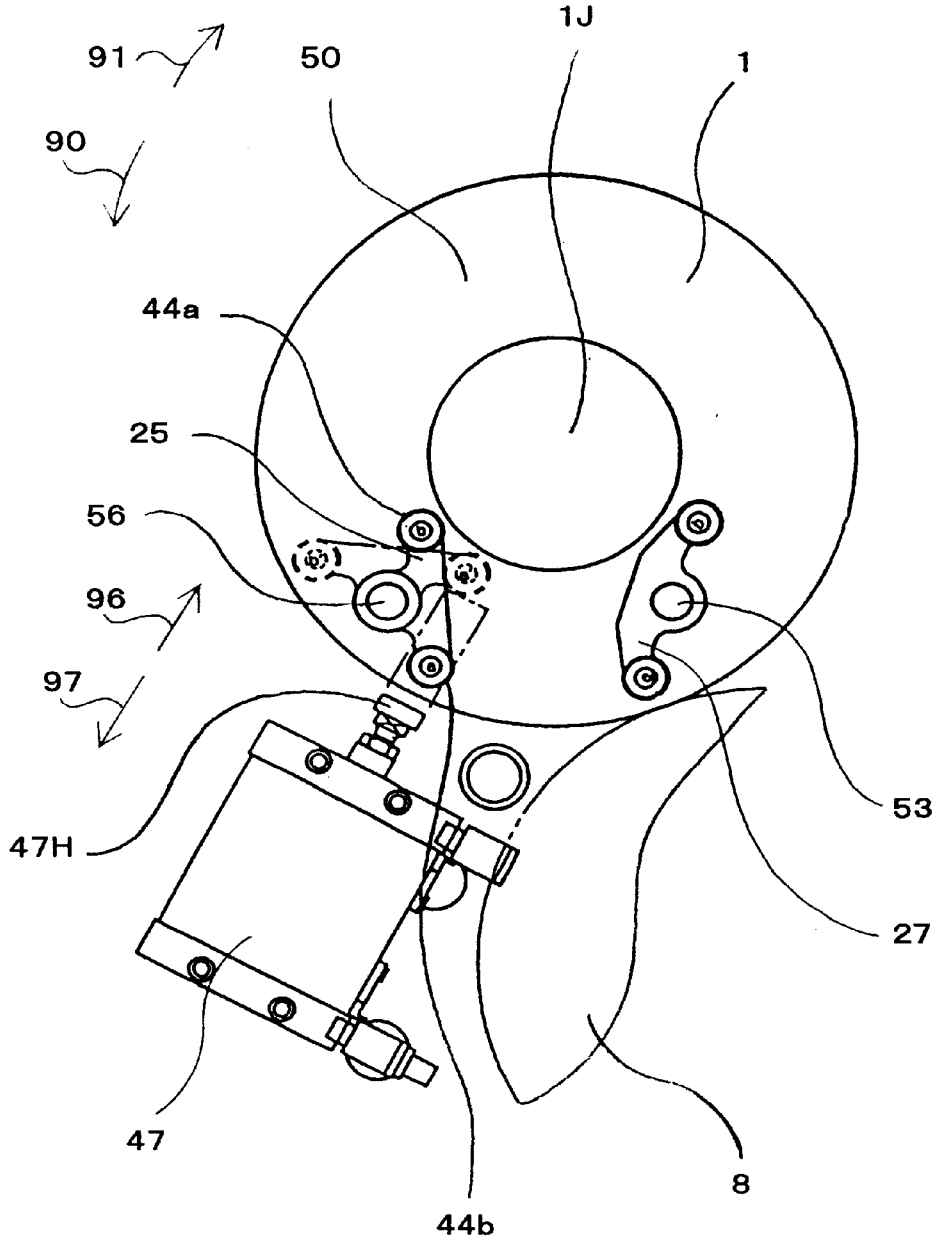
FIG. 8 is a side view of an air cylinder 47 and the plate cylinder 1.
Figure 9:
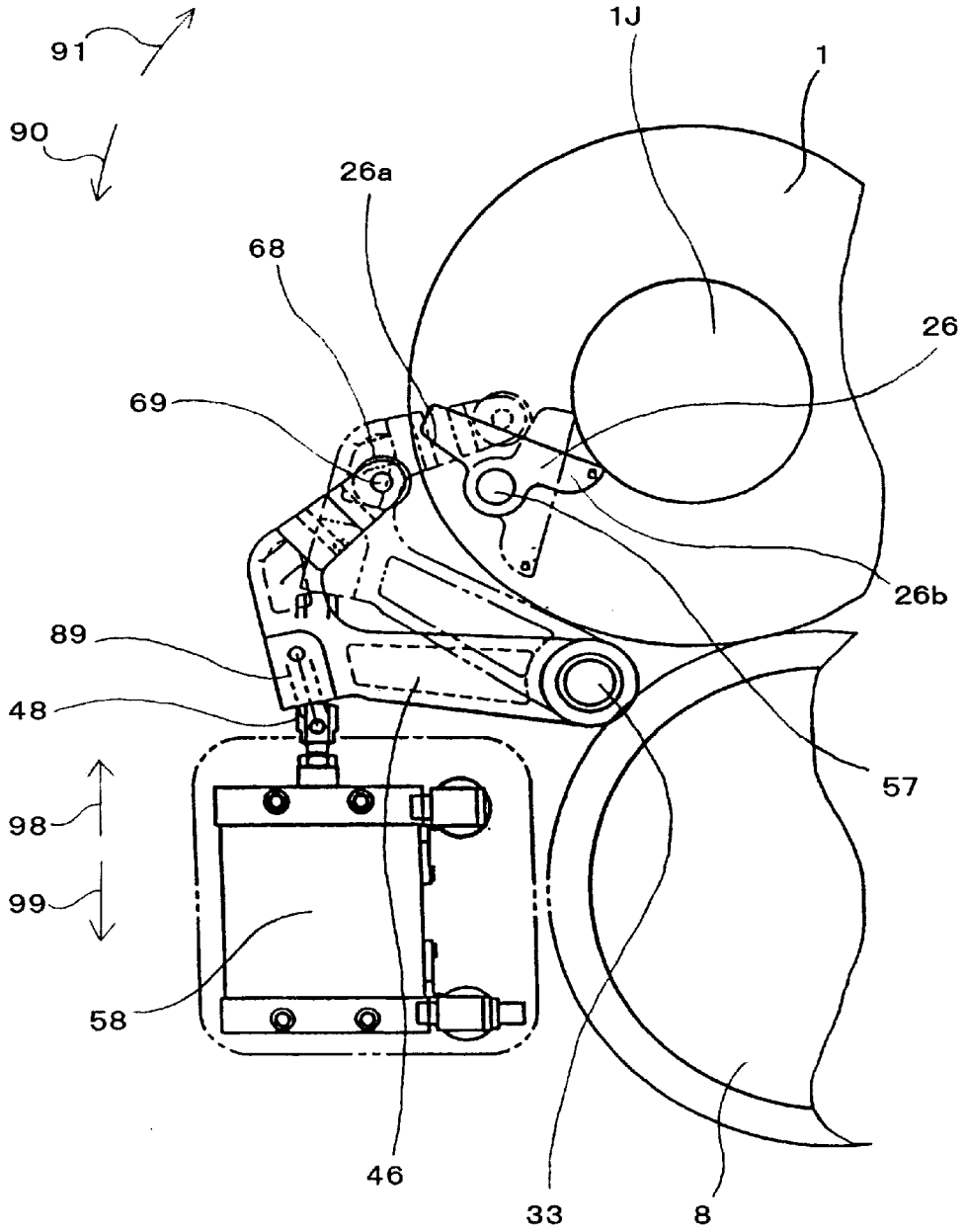
FIG. 9 is another side view of an air cylinder 58 and the plate cylinder 1.
Figure 10:
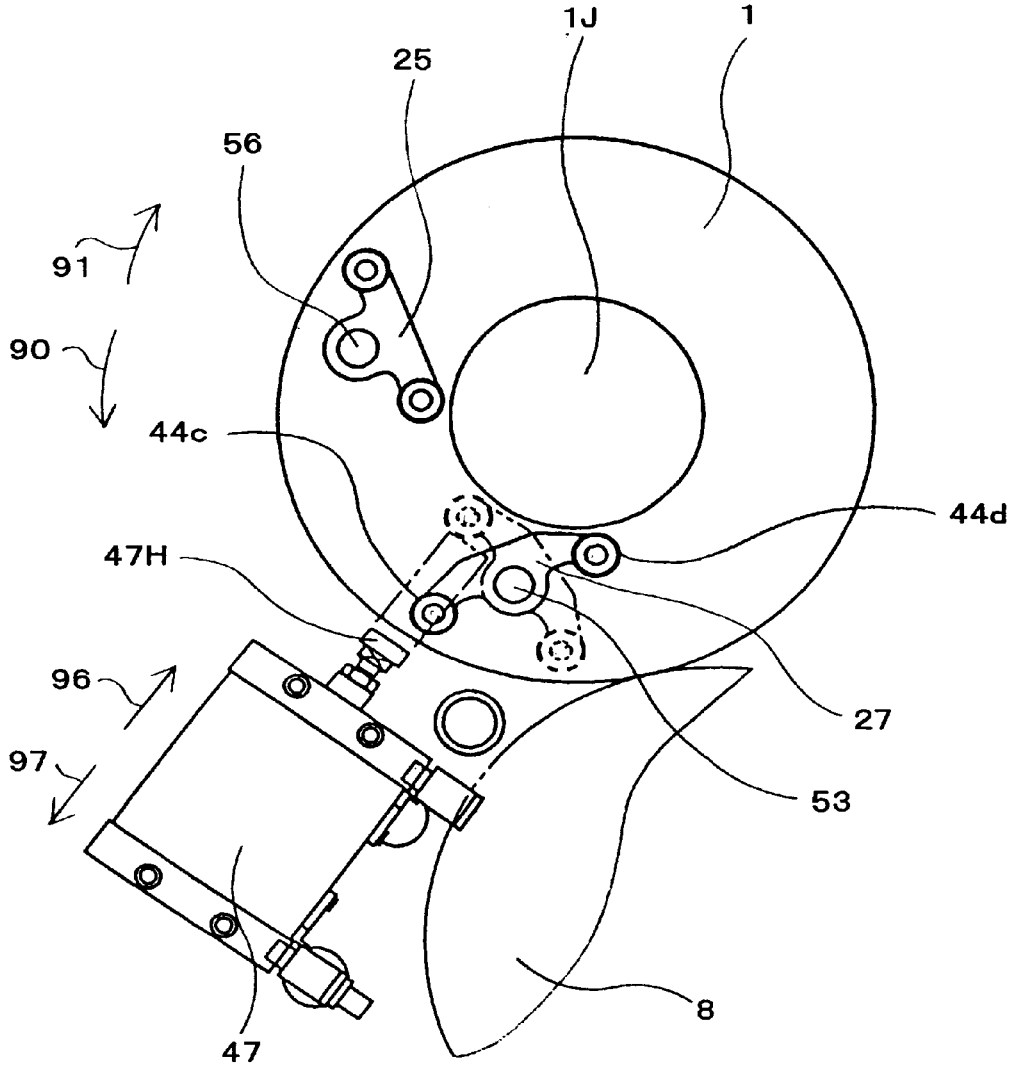
FIG. 10 is another side view of the air cylinder 47 and the plate cylinder 1.

FIG. 7 is a plan view of the plate cylinder 1 and periphery thereof. Also, FIG. 8, FIG. 9 and FIG. 10 are side views of the plate cylinder 1.

Figure 11:
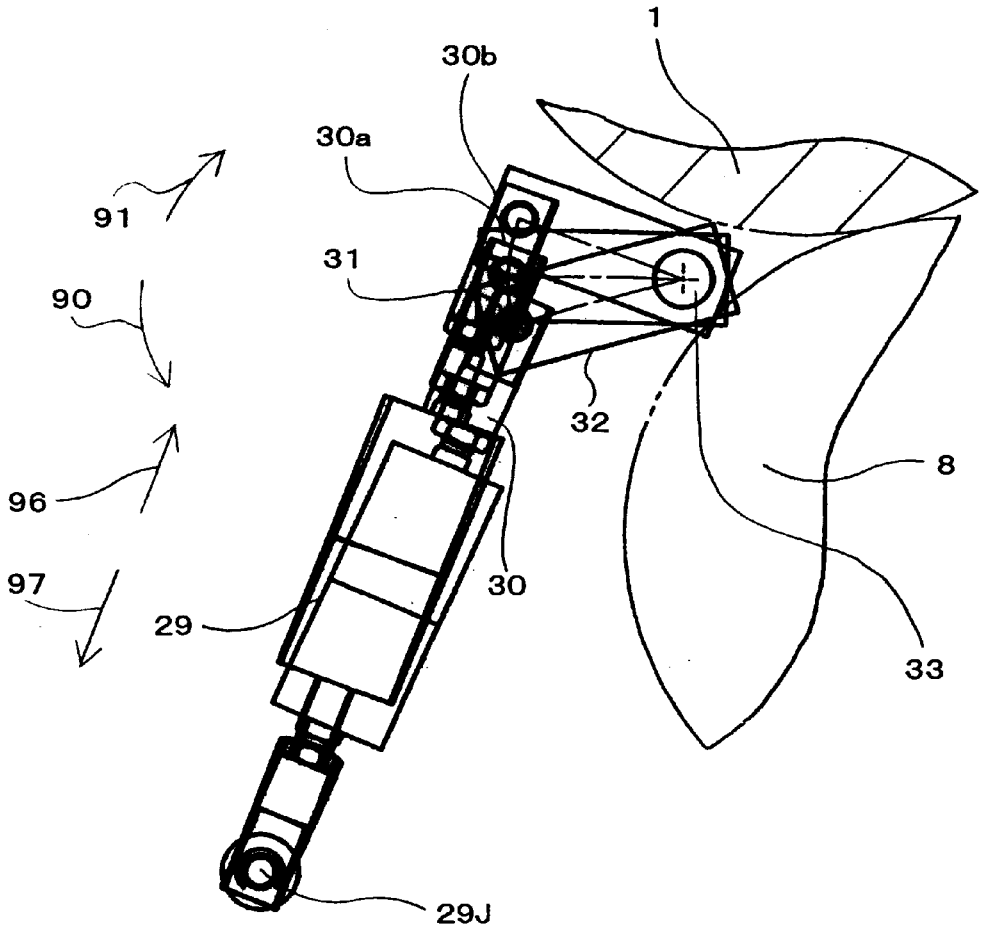
FIG. 11 is a side view of another air cylinder 29 and periphery thereof.
Figures 12A, 12B, 12C:
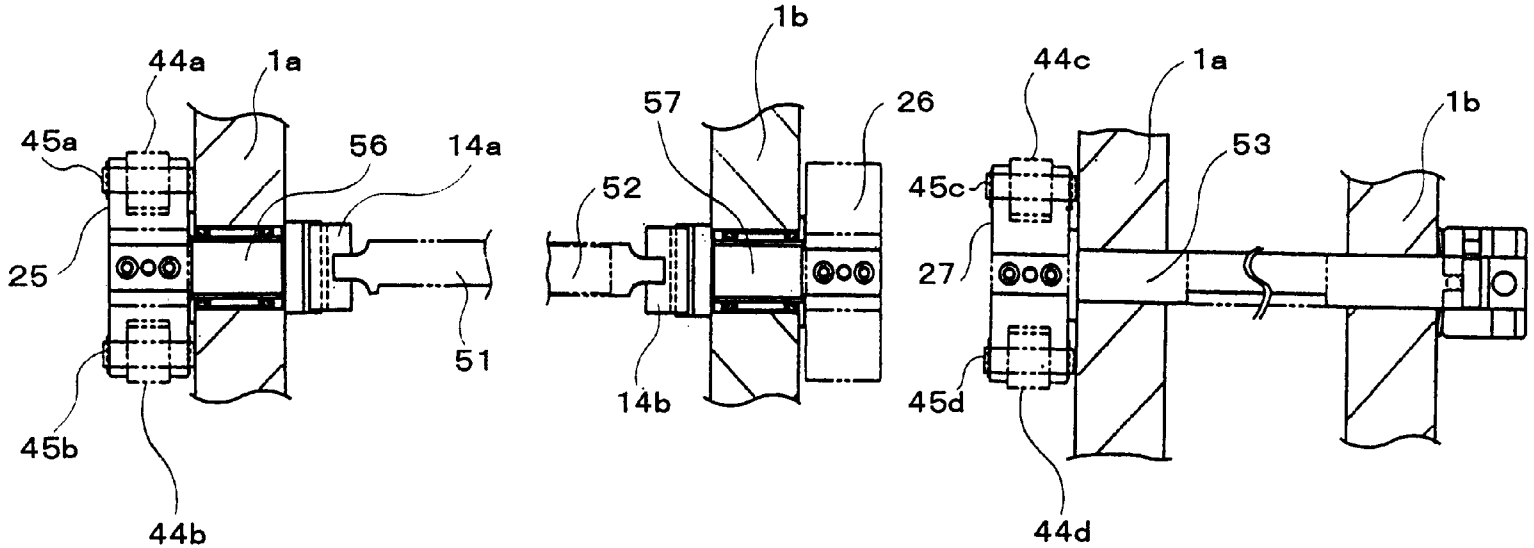
FIG. 12A is a plan view including partially cutaway view illustrating an end of a leading edge side cam shaft 51 and periphery thereof.
FIG. 12B is another plan view including partially cutaway view illustrating an end of a tail edge side cam shaft 52 and periphery thereof.
FIG. 12C is a plan view including partially cutaway view illustrating ends of a plate tensioning cam shaft 53 and periphery thereof.

Further, FIG. 11 is a side view of an air cylinder 29 and periphery thereof, and FIG. 12A, FIG. 12B and FIG. 12C are plan views including partially cutaway views illustrating an end of a leading edge side cam shaft 51, an end of a tail edge side cam shaft 52 and ends of a plate tensioning cam shaft 53 and periphery thereof.

Figure 13A:
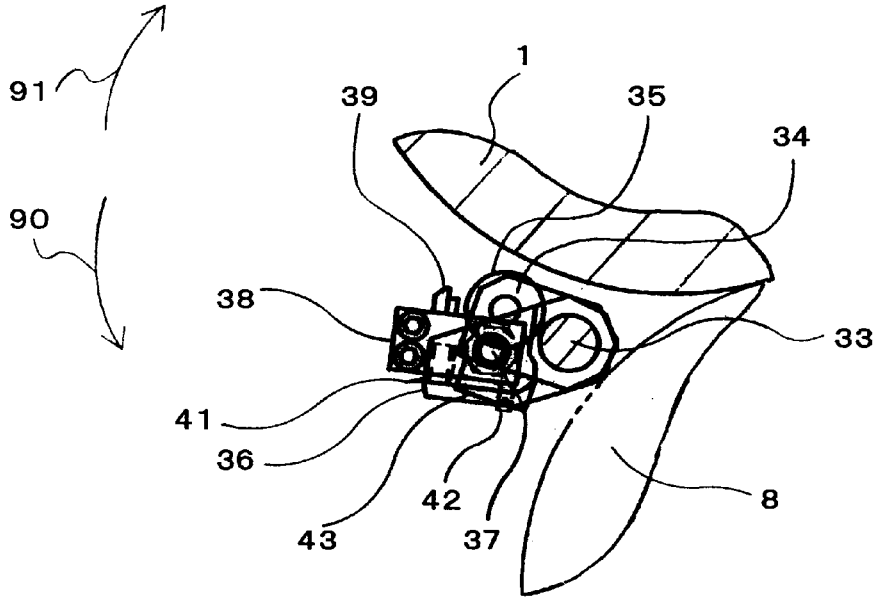
FIG. 13A is a side view illustrating a pressure mechanism 66 and periphery thereof.
Figure 13B:
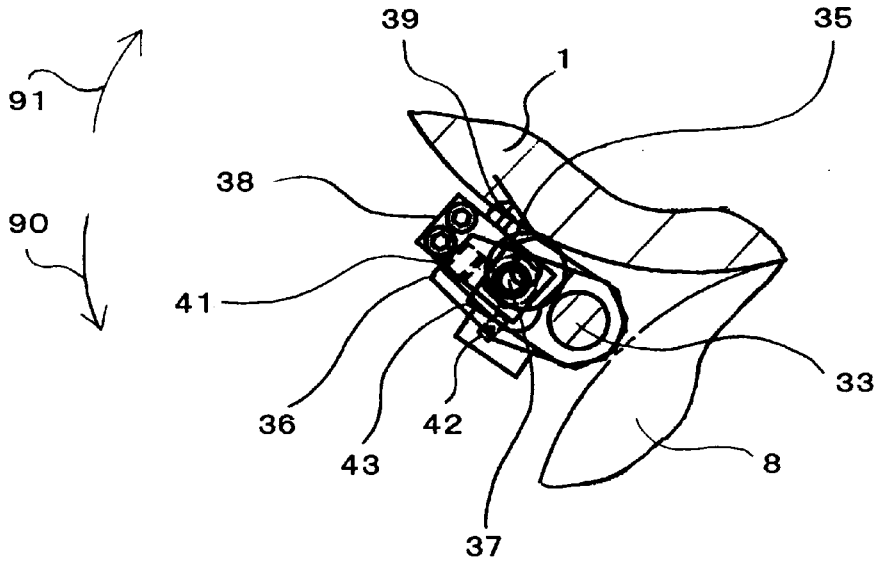
FIG. 13B is another side view illustrating a pressure mechanism 66 and periphery thereof.
Figure 14A:
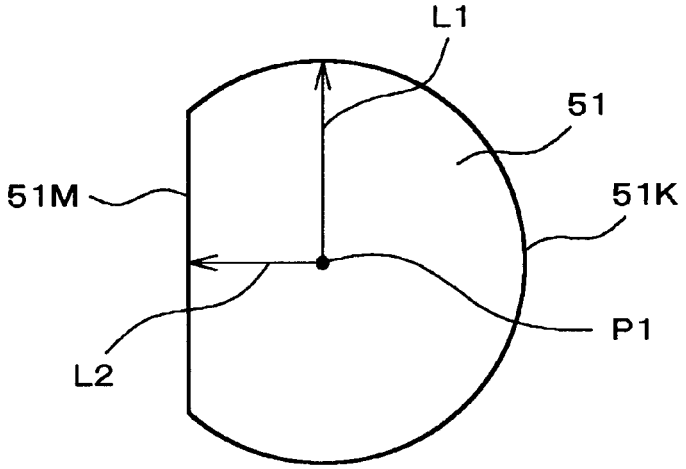
FIG. 14A is an enlarged cross sectional view of the leading edge side cam shaft 51.
Figure 14B:
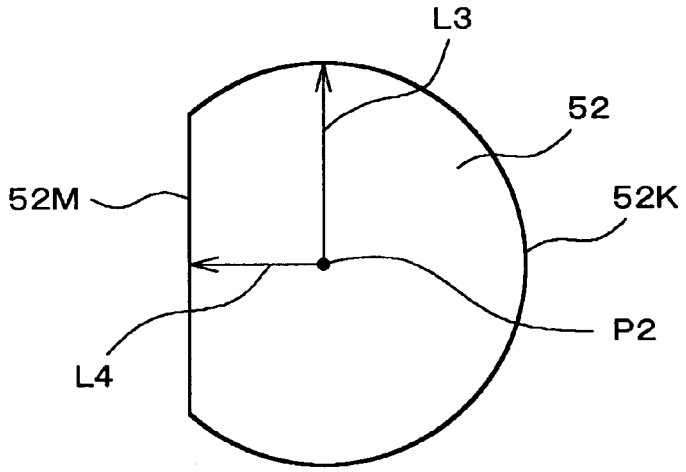
FIG. 14B is an enlarged cross sectional view of the leading edge side cam shaft 52.
Figure 14C:
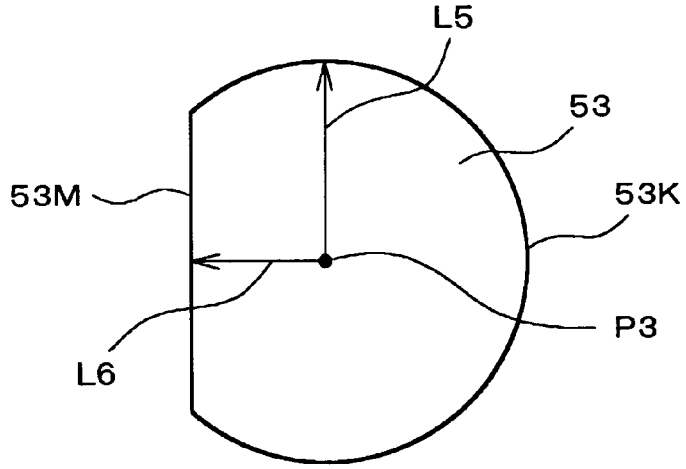
FIG. 14C is an enlarged cross sectional view of the plate tensioning cam shaft 53.
Figure 15A:
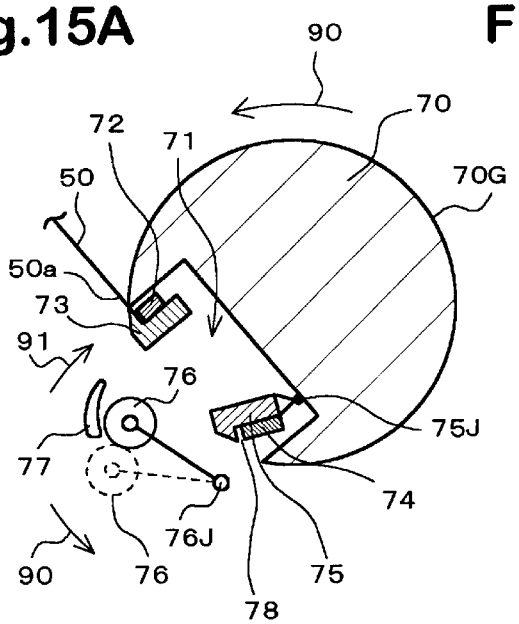
FIG. 15A is a sectional side elevation of a device for clamping an edge of a plate for a printing machine of a first prior art, showing a procedure for disposing the plate 50 on a plate cylinder 70.
Figure 15B:
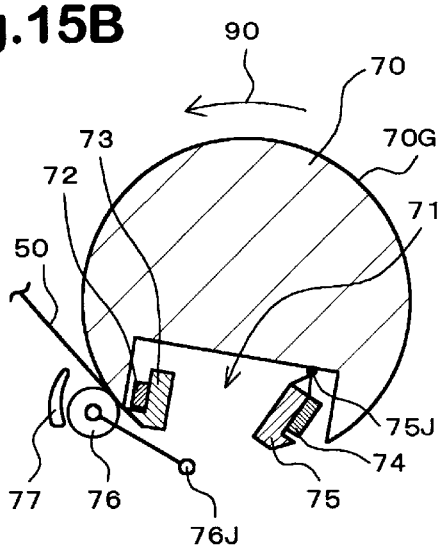
FIG. 15B is another sectional side elevation of the device of the first prior art, showing the procedure for disposing the plate 50 on the plate cylinder 70.
Figure 15C:
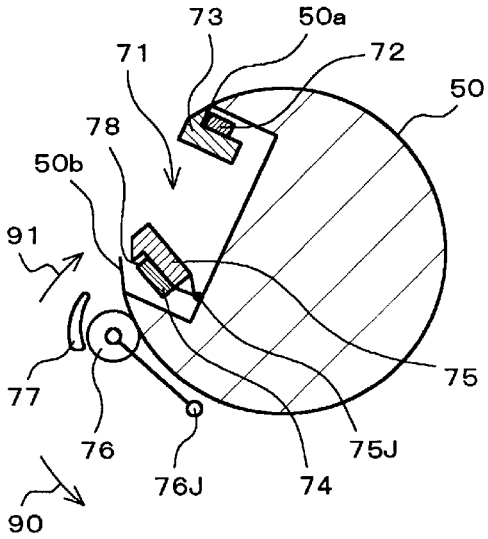
FIG. 15C is another sectional side elevation of the device of the first prior art, showing the procedure for disposing the plate 50 on the plate cylinder 70.
Figure 15D:
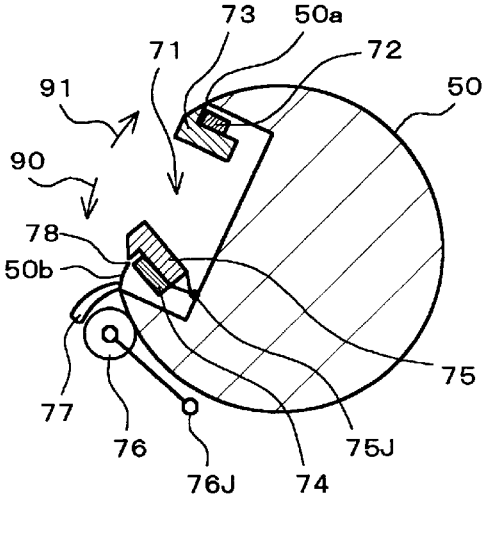
FIG. 15D is another sectional side elevation of the device of the first prior art, showing the procedure for disposing the plate 50 on the plate cylinder 70.
Figure 16:
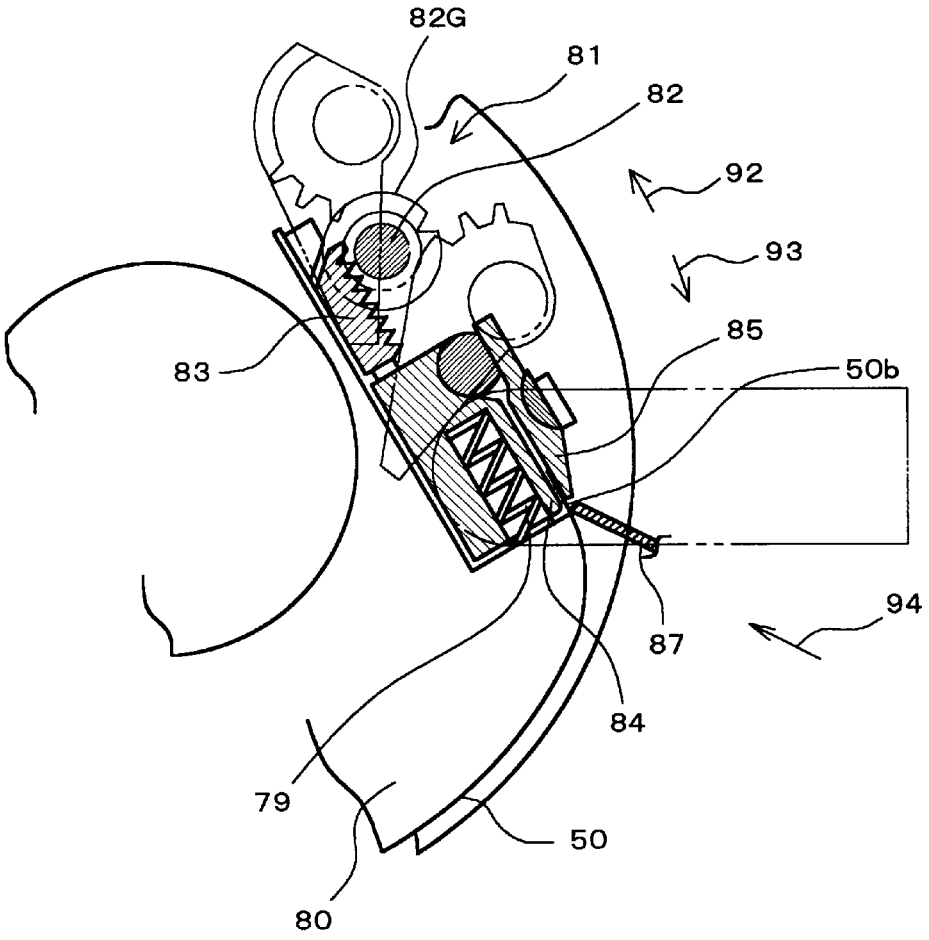
FIG. 16 is a sectional side elevation of a device for clamping an edge of a plate for a printing machine of a second prior art.

FIG. 13A and FIG. 13B are side views illustrating a pressure mechanism 66 and periphery thereof, and FIG. 14A, FIG. 14B and FIG. 14C are enlarged cross sectional views of the leading edge side cam shaft 51, the leading edge side cam shaft 52 and the leading edge side cam shaft 53.

An overall structure of the plate cylinder 1 mounting the device for clamping the edge of the plate in the present invention is described herein. A cut-out part 2 is formed in the plate cylinder 1 as shown in FIG. 1, and a leading edge side clamp 61 and a tail edge side clamp 62 are mounted in the cut-out part 2. The plate cylinder 1 is rotatable around a rotating axis 1J, and a plate 50 is disposed on a cylinder surface of the plate cylinder 1. The printing work is carried out after disposing the plate 50 on the plate cylinder 1.

A leading edge side part 50*a* of the plate 50 is clamped with the leading edge side clamp 61. The leading edge side clamp 61 is mainly composed of a leading edge side lower plate 3 and a leading edge side upper plate 4 (see FIG. 4A, FIG. 4B and FIG. 4C). The leading edge side part 50*a* of the plate 50 is clamped and fixed by closing the leading edge side upper plate 4 to the leading edge side lower plate 3.

The plate 50 thus fixing the leading edge side part 50*a* is disposed on the cylinder surface of the plate cylinder 1. Upon disposing the plate 50 on the cylinder surface, a tail edge side part 50*b* is clamped with the tail edge side clamp 62. The tail edge side clamp 62 is mainly composed of a tail edge side lower plate 6 forming a base and a tail edge side upper plate 7 acting as an opening and closing part (see FIG. 5A, FIG. 5B, FIG. 6A and FIG. 6B). The tail edge side part 50*b* is clamped and fixed with the tail edge side clamp 62 by closing the tail edge side upper plate 7 to the tail edge side lower plate 6.

Upon clamping the tail edge side part 50*b* of the plate 50, the tail edge side clamp 62 is moved in the direction of the arrow 92 shown in FIG. 1 (see FIG. 6B), so that the plate 50 is fitted tightly on the cylinder surface of the plate cylinder 1 by applying tension to the plate 50. The position of the tail edge side lower plate 6 shown in FIG. 2A, FIG. 2B, FIG. 3A, FIG. 3B, FIG. 5A, FIG. 5B and FIG. 6A is an initial position in this embodiment, and the position of the tail edge side lower plate 6 shown in FIG. 6B is a moved position in the embodiment.

Details of the leading edge side clamp 61 are described herein in accordance with FIG. 1, FIG. 4A, FIG. 4B and FIG. 4C. As described above, the leading edge side clamp 61 is mainly composed of the leading edge side lower plate 3 and the leading edge side upper plate 4. As shown in FIG. 4A, FIG. 4B and FIG. 4C, the leading edge side lower plate 3 is provided in the cut-out part 2 of the plate cylinder 1.

The leading edge side upper plate 4 is connected to the leading edge side lower plate 3 through connecting bolts 10.

Washers 11 are existing between the connecting bolts 10 and the leading edge side upper plate 4. The washers 11 are formed in a spherical segment as shown in FIG. 4A and FIG. 4B. The leading edge side upper plate 4 can pivotally be moved in the directions of the arrow 90 and the arrow 91 along with the spherical surface of the washers 11.

Both FIG. 4B and FIG. 4C show conditions that a forward end of the leading edge side upper plate 4 is closed by moving in the direction of the arrow 91 from the condition shown in FIG. 4A. Coils springs 12 are provided in the leading edge side lower plate 3, so that leading edge side upper plate 4 is urged with the coil springs 12 so as to open against the leading edge side lower plate 3. In other words, the leading edge side upper plate 4 pushed in the direction of the arrow 90.

Further, a groove 13 for installing a cam shaft is formed in the leading edge side lower plate 3, and a leading edge side cam shaft 51 is rotatably installed therein. FIG. 14A is an enlarged cross sectional view of the leading edge side cam shaft 51. The leading edge side cam shaft 51 comprises a circumferential surface 51K and a flat surface 51M. A length L1 representing the length between a rotating axis P1 to the circumferential surface 51K is formed so as to be longer than a length L2 indicating the length between the rotating axis P1 to the flat surface 51M as shown in FIG. 14A.

FIG. 4A shows a condition that the flat surface 51M of the leading edge side cam shaft 51 is in contact with the bottom of the leading edge side upper plate 4. In this case, the leading edge side upper plate 4 is urged in the direction of the arrow 90 by the coil springs 12 (FIG. 4C). As a result, a leading edge side space 4S is formed between the leading edge side upper plate 4 and the leading edge side lower plate 3. On the other hand, both FIG. 4B and FIG. 4C show conditions that the circumferential surface 51K is in contact with the bottom of the leading edge side upper plate 4 by the rotation of the leading edge side cam shaft 51. In the conditions, the bottom of the leading edge side upper plate 4 is pushed with the circumferential surface 51K, as a result, the leading edge side upper plate 4 is closed by moving in the direction of the arrow 91.

As shown in FIG. 1, a coupling 14*a* is connected to an end of the leading edge side cam shaft 51, and the leading edge side cam shaft 51 is connected with a connecting rod 56 through the coupling 14*a*. FIG. 12A is a plan view including partially cutaway view illustrating the leading edge side cam shaft 51 and periphery thereof. The connecting rod 56 rotatably passes through the outside of a side wall 1*a*, and an arm 25 for clamping the leading edge side is connected to the connecting rod 56 as one united body. Rollers 44*a* and 44*b* are rotatably provided to the arm 25 via pins 45*a* and 45*b*.

An air cylinder 47 is fixed to a frame 67*a* as shown in FIG. 7. A rod 47H of the air cylinder 47 is movable in both directions of an arrow 96 and an arrow 97 shown in FIG. 8. The roller 44*b* is pushed by the rod 47H thus extended in the direction of the arrow 96 when the roller 44*b* of the arm 25 is located somewhere on a track formed by a movement of the rod 47H. Consequently, the leading edge side upper plate 4 is closed as shown in FIG. 4B and FIG. 4C from the condition shown in FIG. 4A by the rotation of the connecting rod 56 and the leading edge side cam shaft 51.

Further, the roller 44*a* is pushed by the rod 47H extended In the direction of the arrow 96 when the roller 44*a* of the arm 25 is located somewhere on the track formed by the movement of the rod 47H. As a result, the leading edge side upper plate 4 is opened as shown in FIG. 4A from the conditions shown in FIG. 4B and FIG. 4C by the rotation of the connecting rod 56 and the leading edge side cam shaft 51.

Details of the tail edge side clamp 62 are described herein in accordance with FIG. 1, FIG. 5A, FIG. 5B, FIG. 6A and FIG. 6B. As described above, the tail edge side clamp 62 is mainly composed of the tail edge side lower plate 6 and the tail edge side upper plate 7. As shown in FIG. 1, a plurality of supporting blocks 15 are fixed to the tail edge side lower plate 6. A pin 16 forming a pivot is mounted on the supporting blocks 15, and the tail edge side upper plate 7 is rotatably connected to the pin 16 in the directions of the arrow 90 and the arrow 91 (FIG. 5A, FIG. 5B, FIG. 6A and FIG. 6B).

In this embodiment, the direction of the arrow 90 is a closing direction of the tail edge side upper plate 7 and the direction of the arrow 91 is a opening direction of the tail edge side upper plate 7.

A plurality of springs 17 are provided between the tail edge side lower plate 6 and the tail edge side upper plate 7 in a spaced fashion. The tail edge side upper plate 7 is urged by the springs 17 in the direction of the arrow 91. A plurality of bolts 19 are fixed to a back side of the tail edge side upper plate 7.

The tail edge side cam shaft 52 is rotatably located in the supporting blocks 15. FIG. 14B is an enlarged cross sectional view of the tail edge side cam shaft 52. The tail edge side cam shaft 52 comprises a circumferential surface 52K and a flat surface 52M. A length L3 representing the length between a rotating axis P2 to the circumferential surface 52K is formed so as to be longer than a length L4 indicating the length between the rotating axis P2 to the flat surface 52M as shown in FIG. 14B.

FIG. 5A shows a condition that the flat surface 52M of the tail edge side cam shaft 52 is in contact with the bolts 19. In this case, the tail edge side upper plate 7 is urged in the direction of the arrow 91 with the bolts 19, as a result, the tail edge side upper plate 7 is located at a position so as to be opened to the tail edge side lower plate 6. A space 7S formed at the tails edge side acting as an inserting space is formed between an upper surface 7M of the tail edge side upper plate 7 and a lower surface 6M of the tail edge side lower plate 6.

Both the upper surface 7M and the lower surface 6M are the parts pressurize directly to the tail edge side part 50*b* of the plate 50. The upper surface 7M forms a clamping surface, and the lower surface 6M acts as a base surface in this embodiment.

FIG. 5B, FIG. 6A, FIG. 6B show conditions that the circumferential surface 52K is in contact with the bolts 19 as a result of rotating the tail edge side cam shaft 52 from the condition shown in FIG. 5A. The bolts 19 are pushed by the circumferential surface 52K, so that the tail edge side upper plate 7 is moved in the direction of the arrow 90 by centering around the pin 16. As a result, the upper surface 7M is in full contact with the lower surface 6M.

As shown in FIG. 1, another coupling 14*b* is connected to an end of the tail edge side cam shaft 52, and the tail edge side cam shaft 52 is connected to another connecting rod 57 through the coupling 14*b*. FIG. 12B is a plan view including partially cutaway view illustrating the tail edge side cam shaft 52 and periphery thereof. The connecting rod 57 rotatably passes through the outside of another side wall 1*b*, and another arm 26 for clamping the tail edge side is connected to the connecting rod 57 as one united body.

Another air cylinder 58 is fixed to another frame 67*b* as shown in FIG. 7. Another arm 46 is connected to a rod 48 of the air cylinder 58 through a spring 89 (see FIG. 7 and FIG. 9). The arm 46 is rotatably connected to a shaft 33 forming a rotating shaft. Also, the shaft 33 is supported by both the frame 67*a* and the frame 67*b*.

A roller 68 is rotatably provided to a forward end of the arm 46 connected to the shaft 33, and the roller 68 is connected to the arm 46 via a pin 69. The arm 46 is rotated in the direction of the arrow 91 by centering around the shaft 33 when the rod 48 of the air cylinder 58 is extended to a direction of an arrow 98 shown in FIG. 9. On the other hand, the arm 46 is rotated in the direction of the arrow 90 by centering around the shaft 33 as a result of connection between the arm 46 and the rod 48 via the spring 89 when the rod 48 of the air cylinder 58 is extended to a direction of an arrow 99 shown in FIG. 9.

An end 26*a* of the arm 26 is pushed with the roller 68 by the movement thereof in the direction of the arrow 91 when the end 26*a* of the arm 26 is located somewhere on a track formed by a movement of the roller 68. As a result, the tail edge side upper plate 7 is closed as shown in FIG. 5B, FIG. 6A and FIG. 6B from the condition shown in FIG. 5A by the rotation of the connecting rod 57 and the tail edge side cam shaft 52.

Further, another end 26*b* of the arm 26 is pushed with the roller 68 by the movement thereof in the direction of the arrow 90 when the end 26*b* of the arm 26 is located somewhere on another track formed by the movement of the roller 68. As a result, the tail edge side upper plate 7 is opened as shown in FIG. 5A from the conditions shown in FIG. 5B, FIG. 6A and FIG. 6B by the rotation of the connecting rod 57 and the tail edge side cam shaft 52.

A groove 18 is located in the cut-out part 2 formed in the plate cylinder 1 as shown in FIG. 5A, FIG. 5B, FIG. 6A and FIG. 6B. A convex 6T formed on the tail edge side lower plate 6 is inserted into the groove 18, and the tail edge side lower plate 6 is movable in the directions of the arrow 92 and the arrow 93. As shown in FIG. 6A and FIG. 6B, a plurality of coil springs 28 are provided between an inner wall of the cut-out part 2 and the tail edge side lower plate 6 in a spaced fashion. The tail edge side lower plate 6 is urged in the direction of the arrow 92 by the spring force of the coil springs 28.

The tail edge side upper plate 7, the supporting blocks 15 and periphery thereof are moved together with the tail edge side lower plate 6 as one united body when the tail edge side lower plate 6 is moved in the directions of the arrow 92 and the arrow 93. As described above, the tail edge side cam shaft 52 is connected to the connecting rod 57 through the coupling 14*b*. In this way, the rotation of the connecting rod 57 can be conveyed reliably to the tail edge side cam shaft 52 via the coupling 14*b* existing therebetween even when a rotating axis of the tail edge side cam shaft 52 is shifted from a rotating axis of the connecting rod 57 as a result of moving the tail edge side cam shaft 52 in the directions of the arrow 92 and the arrow 93.

Further, a concave 5 is formed in the bottom part of the tail edge side lower plate 6. The plate tensioning cam shaft 53 is located in the concave 5. FIG. 14C is an enlarged cross sectional view of the plate tensioning cam shaft 53. The plate tensioning cam shaft 53 also comprises a circumferential surface 53K and a flat surface 53M. A length L5 representing the length between a rotating axis P3 to the circumferential surface 53K is formed so as to be longer than a length L6 indicating the length between the rotating axis P3 to the flat surface 53M as shown in FIG. 14C.

FIG. 5A, FIG. 5B and FIG. 6A show conditions that the circumferential surface 53K of the plate tensioning cam shaft 53 is in contact with an inner wall of the concave 5. In this case, movement of the tail edge side lower plate 6 in the direction of the arrow 92 is restricted by the plate tensioning cam shaft 53.

FIG. 6B shows a condition that the flat surface 53M is in contact with the inner wall of the concave 5 by the rotation of the plate tensioning cam shaft 53. The restriction to the tail edge side lower plate 6 caused by the circumferential surface 53K of the plate tensioning cam shaft 53 is released by locating the flat surface 53M substantially parallel to the inner wall of the concave 5. As a result, the tail edge side lower plate 6 is moved in the direction of the arrow 92 by the spring force of the coil springs 28. Consequently, the movement of the tail edge side lower plate 6 is suspended by contacting the inner wall of the concave 5 with the flat surface 53M of the plate tensioning cam shaft 53.

As shown in FIG. 1, the plate tensioning cam shaft 53 rotatably passes through the outside of the side wall 1*b*, and another arm 27 for tensioning the plate is connected to the plate tensioning cam shaft 53 as one united body. Rollers 44*c* and 44*d* are rotatably provided to the arm 27 via pins 45*c* and 45*d*. FIG. 12C is a plan view including partially cutaway view illustrating a plate tensioning cam shaft 53 and periphery thereof.

The roller 44*c* of the arm 27 is pushed by the rod 47H extended in the direction of the arrow 96 when the roller 44*c* is located somewhere on another track formed by the movement of the rod 47H. As a result, the tail edge side lower plate 6 is moved in the condition shown in FIG. 6B from the conditions shown in FIG. 5A, FIG. 5B and FIG. 6A by the rotation of the plate tensioning cam shaft 53.

Further, the roller 44*d* of the arm 27 is pushed by the rod 47H extended in the direction of the arrow 96 when the roller 44*d* is located somewhere on another track formed by the movement of the rod 47H. As a result, the tail edge side lower plate 6 is moved toward the other way in the conditions shown in FIG. 5A, FIG. 5B and FIG. 6A from the condition shown in FIG. 6B by the rotation of the plate tensioning cam shaft 53.

Figure 3A:
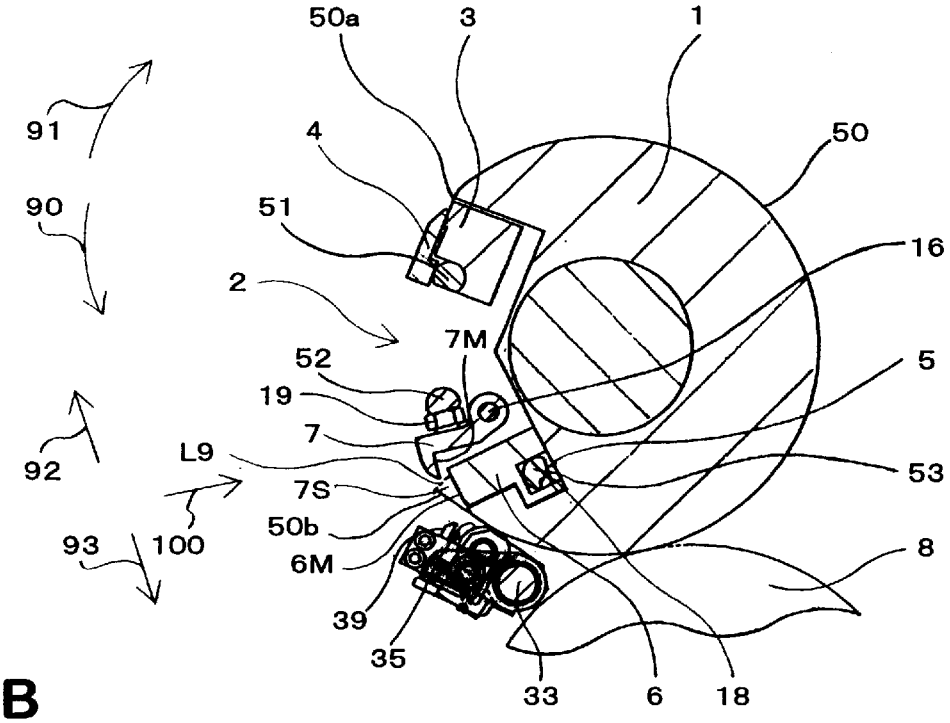
FIG. 3A is another cross sectional view taken along line U—U of FIG. 1, showing a procedure for disposing the plate 50 on the plate cylinder.
Figure 3B:
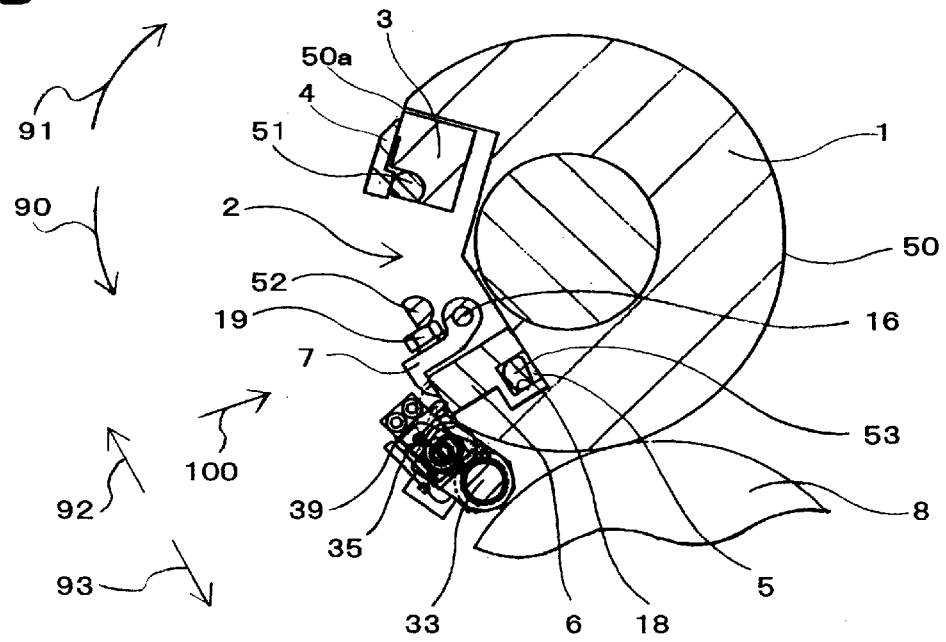
FIG. 3B is another cross sectional view taken along line U—U of FIG. 1, showing a procedure for disposing the plate 50 on the plate cylinder.

The plate 50 is pressurized to the cylinder surface of the plate cylinder 1 with a pressure roller 35 acting as a pressurize part so as to firmly contact to the cylinder surface when the plate 50 is disposed on the cylinder surface of the plate cylinder (see FIG. 3A and FIG. 3B). Further, the tail edge side part 50*b* of the plate 50 is guided into the space 7S by pushing force of a blade 39 forming a guide part after disposing the plate 50 on the cylinder surface (see FIG. 3A and FIG. 3B).

The pressurize mechanisms for operating the pressure roller 35 and the blade 39 are described herein in accordance with FIG. 7, FIG. 11, FIG. 13A and FIG. 13B. Another arm 32 is fixed to one end of the shaft 33 rotatably supported to the frame 67*a* and the frame 67*b* as one united body.

Further, another air cylinder 29 is fixed to the frame 67*b*. The air cylinder 29 is connected to a rotatable shaft 29J so as to be rotated in the direction of the arrow 90 and the arrow 91 (see FIG. 11). A rod 30 of the air cylinder 29 and the arm 32 are connected with each other via a pin 31.

In other words, the shaft 33 is rotated in the directions of the arrow 90 and the arrow 91 by the movement of the rod 30 in the directions of the arrow 96 and the arrow 97, the movement of the rod 30 is caused by actuation of the air cylinder 29. The rod 30 is controlled so as to stop at two different positions such as a first rotation position 30*a* and a second rotation position 30*b*. The positions of the shaft 33 at the first rotation position 30*a* and the second rotation position 30*b* respectively correspond to a first position and a second position.

As shown in FIG. 7, links 34 are provided to the shaft 33 independently rotatable with each other at both ends thereof in between the frame 67*a* and the frame 67*b*. The pressure roller 35 is rotatably supported between the links 34 through bearings (not shown).

Two arms 36 are positioned respectively at the outside of the links 34. The two arms 36 are fixed to the shaft 33. Torsion coil springs 49 forming a part of an elastic part installed to the shaft 33 is provided between the arms 36 and the links 34. The links 34 are urged to a direction of approaching the links 34 to the plate cylinder 1 (such as the direction of the arrow 91 shown in FIG. 13A and FIG. 13B) by the spring force of the torsion coil springs 49. The links 34 are not rotated further in the direction of the arrow 91 from the position shown in FIG. 13A by contacting stoppers (not shown).

Another two links 38 are rotatably supported to each of the arms 36 via pins 37. A plate 40 is fixed between the these two links 38, and the blade 39 is fixed to the plate 40. Compression springs 41 forming a part of the elastic part is provided between the arms 36 and the links 38, and the links 38 are urged in the direction of the arrow 91 shown in FIG. 13A and FIG. 13B. Adjustment screws 42 are screwed into the arms 36 and passing therethrough, so that rotation of the arms 36 in the direction of the arrow 91 is restricted by contacting the links 38 to the adjustment screws 42. As a result, an angle of the links 38 to the arms 36 can be adjusted by adjusting a depth of the adjustment screws 42 screwed into the arms 36.

Figure 2A:
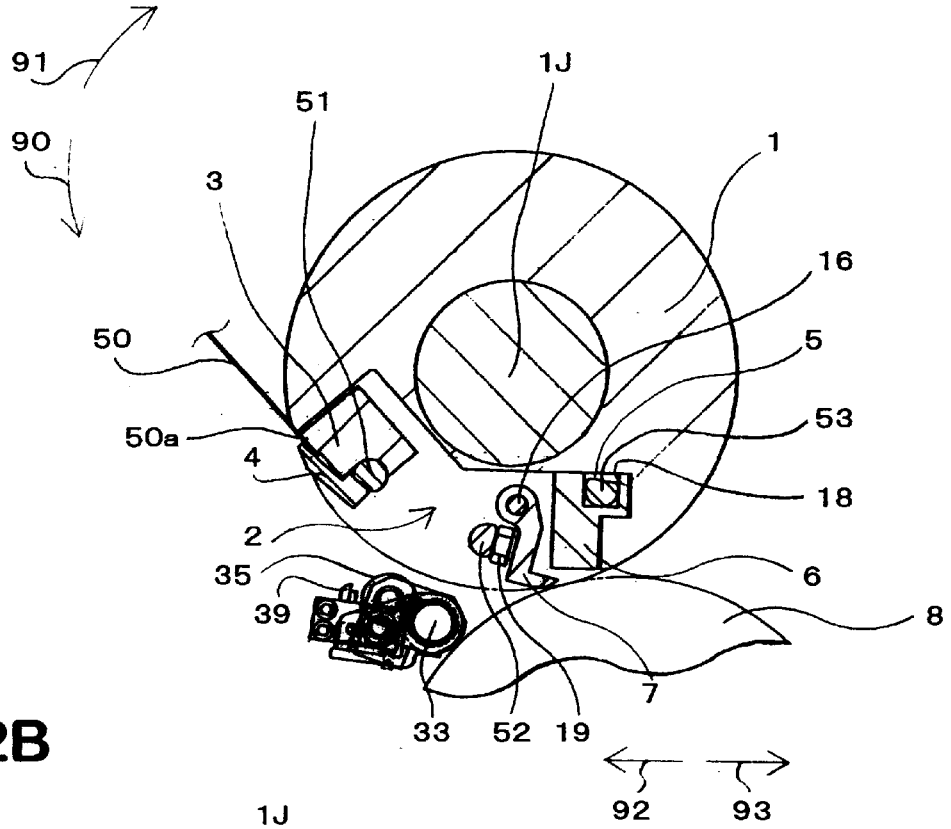
FIG. 2A is a cross sectional view taken along line U—U of FIG. 1, showing a procedure for disposing the plate 50 on a plate cylinder.

Process for disposing the plate 50 on the cylinder surface of the plate cylinder 1 will be described herein in accordance with FIG. 2A, FIG. 2B, FIG. 3A and FIG. 3B by using the mechanisms described above. The leading edge side part 50*a* of the plate 50 is inserted into the leading edge side space 4S (see FIG. 4A) when the leading edge side upper plate 4 is opened to the leading edge side lower plate 3. FIG. 2A shows a condition that the leading edge side part 50*a* is inserted into the leading edge side space 4S.

Then, a starting button (not shown) for initiating the operation is depressed by an operator of the printing machine. The rod 47H of the air cylinder 47 is extended in the direction of the arrow 96 shown in FIG. 8 by the actuation of the air cylinder 47 caused by the operation. At that time, the plate cylinder 1 is located at a position that the roller 44*b* is positioned somewhere on a track formed by the movement of the rod 47H. In this way, the roller 44*b* of the arm 25 is pushed by the rod 47H extended from the air cylinder 47 (see FIG. 8). Consequently, the bottom of the leading edge side upper plate 4 is pushed with the circumferential surface 51K of the leading edge side cam shaft 51 as a result of rotating the connecting rod 56 and the leading edge side cam shaft 51. Therefore, the leading edge side part 50*a* of the plate 50 is clamped with the leading edge side upper plate 4 being closed in the direction of the arrow 91 (see FIG. 4A and FIG. 4B).

Upon clamping the leading edge side part 50*a* of the plate 50, the starting button is depressed again. Rotation of the plate cylinder 1 in the direction of the arrow 90 is started by the operation. In addition, the rod 30 is extended in the direction of the arrow 96 shown in FIG. 11 by the actuation of the air cylinder 29. In this case, extension of the rod 30 is suspended at the first rotation position 30*a*.

Figure 2B:
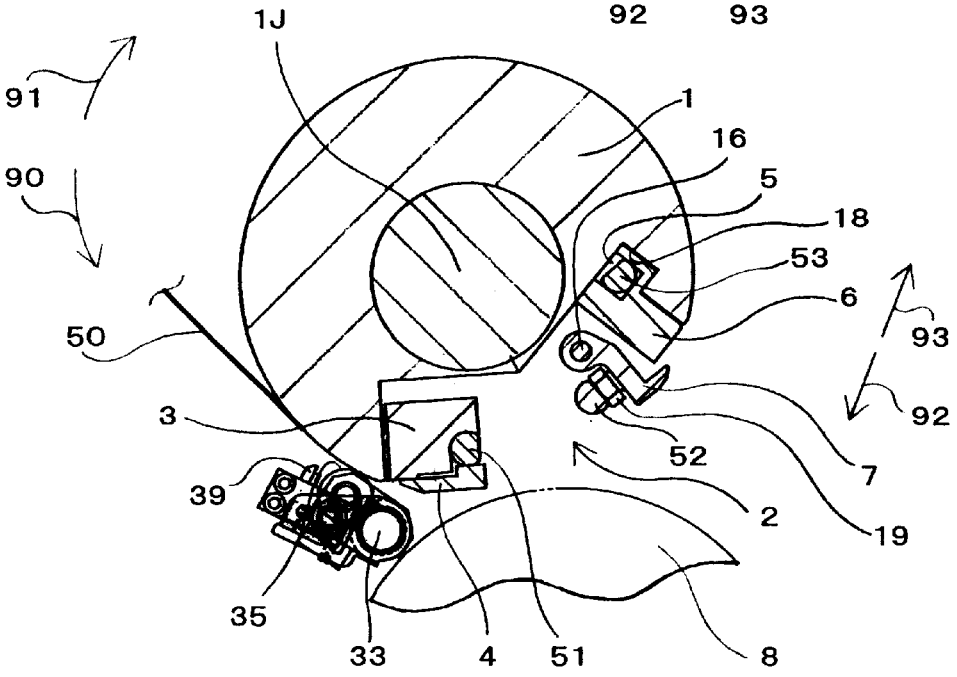
FIG. 2B is another cross sectional view taken along line U—U of FIG. 1, showing a procedure for disposing the plate 50 on the plate cylinder.

The plate 50 is pressurized to the cylinder surface of the plate cylinder 1 with a pressure roller 35 by moving the pressure roller 35 to the plate cylinder 1 as shown in FIG. 2B as a result of rotating the shaft 33 by the actuation of the air cylinder 29. In this case, the pressure roller 35 is pushed to the cylinder surface with sufficient force by the spring force of the torsion coil springs 49 generated by the contraction thereof. In other words, the torsion coil springs 49 absorbs a part of the pushing force applied to the pressure roller 35. A blanket cylinder 8 located adjacent to the plate cylinder 1 is also moved to the plate cylinder 1 so as to pressurize the plate 50 on the cylinder surface.

In this way, the plate 50 is disposed on the cylinder surface of the plate cylinder 1 so as to firmly contact thereto because the plate cylinder 1 is rotated under a condition that the plate 50 is pressurized on the cylinder surface with the blanket cylinder 8 and the pressure roller 35. As a result of the rotation, the plate 50 is in a condition shown in FIG. 3A. At that time, the space 7S is formed between the tail edge side upper plate 7 and the tail edge side lower plate 6 because the tail edge side upper plate 7 is rotated in the direction of the arrow 91.

Rotation of the plate cylinder 1 is suspended at the position shown in FIG. 3A, and the rod 30 is extended to the second rotation position 30*b* from the first rotation position 30*a* shown in FIG. 11 by the actuation of the air cylinder 29. The blade 39 fixed to the plate 40 is moved in the direction of the arrow 91 shown in FIG. 3A and FIG. 3B as a result of rotating the shaft 33 further caused by the extension of the rod 30. Consequently, the tail edge side part 50*b* of the plate 50 is pushed downwardly to the tail edge side lower plate 6 in a direction of an arrow 100 shown in FIG. 3B.

Here, the pin 16 connecting the tail edge side upper plate 7 is allocated at a position far from the lower surface 6M of the tail edge side lower plate 6 and is not allocated adjacent to the lower surface 6M. In this way, a sufficient amount of the space 7S for guiding the tail edge side part 50*b* of the plate 50 therein with the blade 39 is secured by withdrawing the upper surface 7M of the tail edge side upper plate 7 from the lower surface 6M when the tail edge side upper plate 7 is opened in the direction of the arrow 91. Therefore, the tail edge side part 50*b* of the plate 50 is guided on the tail edge side lower plate 6 with higher reliability.

Further, the pin 16 is allocated at a position far away from the lower surface 6M of the tail edge side lower plate 6 in the direction for pushing the tail edge side part 50*b* with the blade 39 (that is the direction of the arrow 100 shown in FIG. 3B) in this embodiment. Consequently, the upper surface 7M of the tail edge side upper plate 7 is located at a position behind a track L9 formed by a forward end of the tail edge side part 50*b* when the tail edge side upper plate 7 is opened in the direction of the arrow 91 as shown in FIG. 3A. In this way, the tail edge side upper plate 7 never be located on the track L9. Consequently, the tail edge side upper plate 7 does not bother insertion of the tail edge side part 50*b* into the space 7S.

The blade 39 is pushed to the tail edge side lower plate 6 with sufficient force by the spring force of the compression springs 41 generated by the contraction thereof when the tail edge side part 50*b* is pushed with the blade 39. In other words, the compression springs 41 absorbs a part of the pushing force applied to the blade 39. The tail edge side part 50*b* of the plate 50 is clamped temporarily between the tail edge side lower plate 6 and the blade 39. Then, the roller 68 is moved in the direction of the arrow 91 shown in FIG. 9 by the actuation of the air cylinder 58.

At that time, the plate cylinder 1 is located at a position that the end 26*a* of the arm 26 is located somewhere on the track formed by the movement of the roller 68. As a result, the end 26*a* of the arm 26 is pushed with the roller 68 by the movement thereof (see FIG. 8). In this way, the tail edge side part 50*b* of the plate 50 is clamped with the tail edge side upper plate 7 being closed in the direction of the arrow 90 as a result of pushing the bolts 19 with the circumferential surface 52K of the tail edge side cam shaft 52 caused by the rotation of both the connecting rod 57 and the tail edge side cam shaft 52 (see FIG. 5B).

As described above, the tail edge side part 50*b* can be clamped reliably between the tail edge side lower plate 6 and the tail edge side upper plate 7 because the tail edge side upper plate 7 is closed at a condition that the tail edge side part 50*b* is clamped between the tail edge side lower plate 6 and the blade 39. Upon clamping the tail edge side part 50*b*, the pressure roller 35 and the blade 39 are returned to the positions shown in FIG. 2A as a result of contraction of the rod 30 in the direction of the arrow 97 shown in FIG. 11 caused by turning off of the air cylinder 29.

Thereafter, the rod 47H of the air cylinder 47 is extended in the direction of the arrow 96 shown in FIG. 10 by the actuation of the air cylinder 47. At that time, the plate cylinder 1 is located at a position that the roller 44*c* is positioned somewhere on the track formed by the movement of the rod 47H. In this way, the roller 44*c* of the arm 27 is pushed by the rod 47H thus extended (see FIG. 10). Consequently, the flat surface 53M is positioned substantially parallel to the inner wall of the concave 5 by the rotation of the plate tensioning cam shaft 53 connected to the arm 27.

The tail edge side lower plate 6 is moved in the direction of the arrow 92 by the spring force of the coil springs 28 in accordance with the rotation of the plate tensioning cam shaft 53. The plate 50 is fitted tightly on the cylinder surface of the plate cylinder 1 as a result of applying tension to the plate 50 by moving the tail edge side lower plate 6 while clamping the tail edge side part 50*b* of the plate 50 between the tail edge side lower plate 6 and the tail edge side upper plate 7.

In order to remove the plate 50 from the plate cylinder 1, rotation of the plate cylinder 1 is controlled so as to locate the roller 44*d* of the arm 27 shown in FIG. 10 somewhere on the track formed by the movement of the rod 47H of the air cylinder 47, and then the air cylinder 47 is actuated. In this way, the tension applied to the plate 50 is released by rotating the plate tensioning cam shaft 53 in the condition shown in FIG. 6A from the condition shown in FIG. 6B as a result of rotating the plate tensioning cam shaft 53 in the direction of the arrow 93.

Then, the rotation of the plate cylinder 1 is controlled so as to locate the end 26*b* of the arm 26 shown in FIG. 9 somewhere on the track formed by the movement of the roller 68 connected to the arm 46, and then the air cylinder 58 is actuated. In this way, the tail edge side part 50*b* of the plate 50 being clamped is released from clamping by rotating both the connecting rod 57 and the tail edge side cam shaft 52 in the condition shown in FIG. 5A from the condition shown in FIG. 5B as a result of opening the tail edge side upper plate 7 in the direction of the arrow 91.

Thereafter, the rotation of the plate cylinder 1 is controlled so as to locate the roller 44*a* of the arm 25 shown in FIG. 8 somewhere on the track formed by the movement of the rod 47H of the air cylinder 47, and then the air cylinder 47 is actuated. In this way, the leading edge side part 50*a* of the plate 50 being clamped is released from clamping by rotating both the connecting rod 56 and the leading edge side cam shaft 51 in the condition shown in FIG. 4A from the condition shown in FIG. 4B as a result of opening the leading edge side upper plate 4 in the direction of the arrow 90. As described above, the plate 50 is removed from the plate cylinder 50.

The device for clamping an edge of a plate for a printing machine in the present invention is not limited to the embodiments described earlier, any other structure can be employed for realizing the characteristics of the present invention. Both the tail edge side lower plate 6 and the tail edge side upper plate 7 are used as the base and the opening and closing part respectively in the embodiment described above. However, other structure having different shape or different parts from the embodiment above may be employed as far as the device is capable of clamping and fixing the edge of the plate and vicinity thereof being inserted into the inserting space by moving the opening and closing part in the closing direction when the base is located at the initial position. The inserting space is formed by moving the opening and closing part in the opening direction.

Although, a mechanism for moving the tail edge side upper plate 7 in the opening direction or the closing direction as a result of rotating the tail edge side upper plate 7 by centering around the pin 16 in the embodiment above, other mechanism for opening and closing the inserting space by linearly moving the tail edge side upper plate 7 to the base can be used.

Further, the blade 39 is introduced as the guide part, other structure having different shape or different parts from the embodiment above may be employed as far as the guide part is capable of guiding the edge of the plate and vicinity thereof into the inserting space. In addition, the edge of the plate and vicinity thereof is guided into the inserting space by the pushing force of the blade 39 in the embodiment described earlier. Other part(s) having different shape or structure from the blade 39 may be employed as the guide part as far as the part(s) is substantially able to guide the edge of the plate and vicinity thereof into the inserting space. For instance, the guide part can be a part which blows or suck the air in order to guide the edge of the plate and vicinity thereof into the inserting space.

Although, the pin 16 is allocated at a position far away from the lower surface 6M of the tail edge side lower plate 6 in the direction for pushing the tail edge side part 50*b* with the blade 39 (that is the direction of the arrow 100 shown in FIG. 3B) in the embodiment above, the present invention is not limited to that structure. Other structure having different shape or mechanism from the mechanism described above may be employed as far as the structure is capable of withdrawing the upper surface 7M of the tail edge side upper plate 7 sufficiently from the lower surface 6M when the tail edge side upper plate 7 is moved in the opening direction.

While the invention has been described in its preferred embodiments, it is to be understood that the words which have been used and words of description rather than limitation and that changes within the purview of the appended claims may be made without departing from the true scope and spirit of the invention in its broader aspects.

The device for clamping an edge of a plate for a printing machine in the present invention is characterized in that, the edge of the plate and the vicinity thereof is guided into the inserting space formed between the clamping surface and the base surface with the guide part when the base is positioned at the initial position, and the edge of the plate and the vicinity thereof is clamped and fixed between the clamping surface and the base surface of the base by moving the opening and closing part in the closing direction when the base is positioned at the initial position.

In this way, the edge of the plate and the vicinity thereof is guided into the inserting space, and is clamped and fixed therein while maintaining the initial position of the base. In other words, the edge of the plate and the vicinity thereof is inserted into the inserting space without movement of the base.

As a result, any movement of the base for inserting the edge of the plate and the vicinity thereof is required, and the edge of the plate and the vicinity thereof can be clamped and fixed by just moving the opening and closing part in the closing direction after guiding the edge of the plate and the vicinity thereof into the inserting space with the guide part. Therefore, both mechanisms and control of the device can be simplified as well as achieving a shorter working period.

Further, the edge of the plate and the vicinity thereof can be inserted into the inserting space reliably because the edge of the plate and the vicinity thereof is guided into the inserting space with the guide part when the base is positioned at the initial position unlike to insert the edge of the plate and the vicinity thereof into the inserting space by moving the base for the insertion.

Still further, the device for clamping an edge of a plate for a printing machine in the present invention is characterized in that, the opening and closing part is moved in the opening direction or in the closing direction by rotating centering around a pivot. The clamping surface of the opening and closing part is withdrawn from the base surface in order to secure a sufficient amount of the inserting space for guiding the edge and the vicinity thereof into the inserting space with the guide part when the opening and closing part is moved in the opening direction by allocating the pivot far away from the base surface of the base.

In this way, the edge of the plate and the vicinity thereof is guided into the inserting space with higher reliability.

The device for clamping an edge of a plate for a printing machine in the present invention is characterized in that, the edge and the vicinity thereof is guided into the inserting space by pushing the edge and the vicinity thereof with the guide part, and the edge and the vicinity thereof is in contact with the base surface by the pushing force of the guide part. And the edge and the vicinity thereof is clamped and fixed by a movement of the opening and closing part in the closing direction with maintaining the contact between the edge and the vicinity thereof and the base surface.

In this way, the edge and the vicinity thereof is clamped and fixed reliably between the clamping surface and the base surface of the base.

What is claimed is:

1. A device for clamping an edge of a plate for a printing machine, comprising:

a plate cylinder;

a base moveably mounted on the plate cylinder, said base having a base surface and being mounted for movement relative to the plate cylinder between an initial position and a moved position;

an opening and closing part mounted on the plate cylinder, said opening and closing part having a clamping surface, and the opening and closing part being mounted for movement between an open position at which an inserting space is defined between the clamping surface and the base surface and a closed position at which the edge of the plate and the vicinity thereof is clamped between the clamping surface and the base surface, and a guide part positioned adjacent said opening and closing part, the guide part engageably guiding the edge of the plate and vicinity thereof into the inserting space, and clamping the edge of the plate and the vicinity thereof to the base surface as said opening and closing part is moved from the open position to the closed position;

wherein said plate cylinder, said base, said opening and closing part, and said guide part are operatively arranged such that said base is at the initial position when said opening and closing part is at the open position, said base is at the initial position when said opening and closing part is moved from the open position to the closed position, and the guide part is engaged with the plate thereby clamping the edge of the plate and the vicinity thereof to the base surface as said opening and closing part is moved from the open position to the closed position.

2. The device for clamping an edge of a plate for a printing machine in accordance with claim 1, wherein said opening and closing part is pivotable around a pivot, said pivot being spaced from said base surface.

3. The device for clamping an edge of a plate for a printing machine in accordance with claim 2, wherein said guide part is positionable above and moveable toward said base surface, and said pivot is positioned below said base surface, wherein said base surface is positioned between said pivot and said guide part.

4. The device for clamping an edge of a plate for a printing machine in accordance with claim 1, wherein the guide part is supported by a rotating shaft, and wherein the guide part is engageable with the edge and the vicinity thereof by rotating around an axis of the rotating shaft.

5. The device for clamping an edge of a plate for a printing machine in accordance with claim 4, wherein an air cylinder is connected to the rotating shaft, and wherein rotation of the rotating shaft is controlled by driving force generated by the air cylinder, and wherein the guide part is rotated in accordance with the rotation of the rotating shaft.

6. The device for clamping an edge of a plate for a printing machine in accordance with claim 4, wherein an elastic part is provided between the guide part and the rotating shaft, and wherein a part of a pushing force of the guide part is absorbable by the elastic part when the edge and the vicinity thereof is pushed by the guide part.

7. The device for clamping an edge of a plate for a printing machine in accordance with claim 4, wherein the device includes a pressurize part for disposing the plate on a cylinder surface of the plate cylinder, and wherein the pressurize part is supported by the rotating shaft, and wherein the plate is disposed on the cylinder surface of the plate cylinder by rotating the pressurize part around the rotating shaft.

8. The device for clamping an edge of a plate for a printing machine in accordance with claim 7, wherein an air cylinder is connected to the rotating shaft, and wherein at least the pressurize part is rotated in accordance with the rotation of the rotating shaft.

9. The device for clamping an edge of a plate for a printing machine in accordance with claim 7, wherein an elastic part is provided between the pressurize part and the rotating shaft, and wherein a part of a pushing force of the guide part is absorbable by the elastic part when the pressurize part is pushed to the cylinder surface of the plate cylinder.

10. The device for clamping an edge of a plate for a printing machine in accordance with claim 7, wherein the pressurize part is rotatable together with the rotating shaft, and wherein the pressurize part is engageable with the plate to push the plate to the cylinder surface of the plate cylinder when the rotating shaft is rotated to a first position, and wherein the guide part is rotatable together with the rotating shaft, and wherein the guide part is engageable with the plate to push the edge and the vicinity thereof when the rotating shaft is further rotated to a second position from the first position.

* * * * *